US011600429B1

(12) United States Patent
Gerdes et al.

(10) Patent No.: US 11,600,429 B1
(45) Date of Patent: Mar. 7, 2023

(54) GEOMETRICALLY CONFIGURABLE PLANAR WAFERS

(71) Applicant: Rockwell Collins, Inc., Cedar Rapids, IA (US)

(72) Inventors: Joshua Gerdes, Aurora, OR (US); Jeffrey J. Deloy, Central City, IA (US); James B. Mayfield, Cedar Rapids, IA (US); Tristan J. Kendall, Central City, IA (US); Steven Stowe, Tigard, OR (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 539 days.

(21) Appl. No.: 16/751,830

(22) Filed: Jan. 24, 2020

(51) Int. Cl.
*H01F 27/28* (2006.01)
*H01F 27/29* (2006.01)
*H01F 27/32* (2006.01)

(52) U.S. Cl.
CPC ..... *H01F 27/2804* (2013.01); *H01F 27/29* (2013.01); *H01F 27/324* (2013.01); *H01F 2027/2819* (2013.01)

(58) Field of Classification Search
CPC .. H01F 2027/281; H01F 27/324; H01F 27/29; H01F 27/2804
See application file for complete search history.

(56) References Cited

U.S. PATENT DOCUMENTS

| | | | | |
|---|---|---|---|---|
| 6,914,508 | B2 * | 7/2005 | Ferencz | H01F 27/2804 336/200 |
| 7,332,993 | B1 | 2/2008 | Nussbaum | |
| 8,013,708 | B2 | 9/2011 | Tsai | |
| 2014/0347154 | A1 | 11/2014 | Schmelzer et al. | |
| 2018/0082777 | A1 | 3/2018 | Vandeplassche et al. | |

FOREIGN PATENT DOCUMENTS

| | | | | |
|---|---|---|---|---|
| CN | 102237187 | B | 4/2013 | |
| CN | 106373733 | A | 2/2017 | |
| DE | 10009078 | C1 | 9/2001 | |
| GB | 2535822 | B | 9/2019 | |
| JP | 2002280230 | A * | 9/2002 | H01F 27/2804 |

OTHER PUBLICATIONS

Planar Transformer Prototyping Kit Designer's Kit C356, Coilcraft, https://www.coilcraft.com/pdfs/PlanarKitManual.pdf, Revised Nov. 15, 2012, 16 pages.
Versatile Planar Transformer, Vishay, https://datasheet.octopart.com/PLAC100S100-Vishay-datasheet-13712928.pdf, Revised Jun. 18, 2009, 7 pages.

* cited by examiner

*Primary Examiner* — Hafizur Rahman
*Assistant Examiner* — Kimberly E Glenn
(74) *Attorney, Agent, or Firm* — Suiter Swantz pc llo

(57) ABSTRACT

A system of modular components each include pin ports that may be connected in different configurations to enact alternative planar designs. Each modular component has asymmetries that are utilized to facilitate alternative wiring. Such asymmetries could include protrusions in the wafer to align edge connections. Alternatively, or in addition, the asymmetries include differences in copper disposition to certain edge connections. Each modular component has a non-conductive coating on each side of the wafer to insulate the underlaying copper layer.

13 Claims, 18 Drawing Sheets

GEOMETRICALLY CONFIGURABLE PLANAR WAFERS

BACKGROUND

With a stock of various magnet wire and cores, engineers can build and prototype a large array of transformers and inductors quickly; the designs ultimately ending up in productionized equipment. Recently, planar magnetics, including transformers and inductors, have become commercially significant. Built using printed circuit board (PCB) layers in place of magnet wire and utilizing flat magnetic cores, planar components have reduced height, high efficiency, high repeatability, low cost, and allow for embedding into the electronic assembly's host PCB.

Prototyping and designing planar components requires time consuming PCB design. Additionally, the mathematical models for such components are extremely complex and performance is difficult to predict, making optimizing the PCB design very difficult. If the planar design requires alteration, the PCB must be redesigned. Furthermore, if the planar component is integrated into an electronic assembly's host PCB, the redesign effort has a negative impact on later design phases.

It would be advantageous to have a system to test and iterate planar designs quickly.

SUMMARY

In one aspect, embodiments of the inventive concepts disclosed herein are directed to a system of modular components with pin ports that may be connected in different configurations to enact alternative planar designs. Each modular component has asymmetries that are utilized to facilitate alternative wiring. Such asymmetries could include protrusions in the wafer to align edge connections. Alternatively, or in addition, the asymmetries include differences in copper disposition to certain edge connections.

In a further aspect, each modular component has a non-conductive coating on each side of the wafer to insulate the underlaying copper layer.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1A:
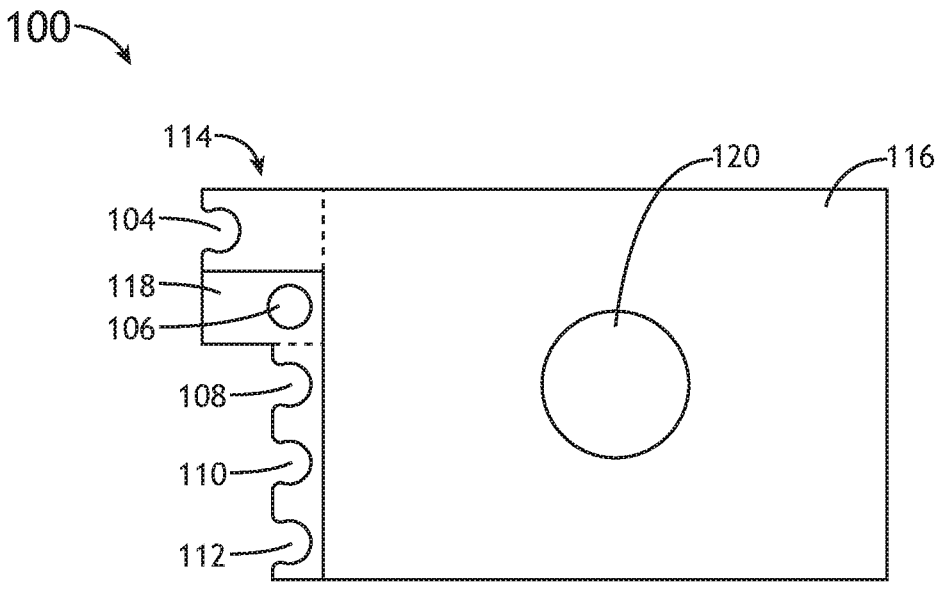
FIG. 1A shows a top view of an exemplary embodiment of wafer.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system of modular components, each with pin ports that may be connected in different configurations to enact alternative planar designs due to asymmetries that are utilized to facilitate alternative wiring. Such asymmetries could include protrusions in the wafer to align edge connections. Alternatively, or in addition, the asymmetries include differences in copper disposition to certain edge connections. It may be appreciated that the FIGS. generally include dashed lines indicating obscured features, and particularly features disposed on an opposing surface. Furthermore, while the specification and corresponding FIGS. describe wafers having between one and four turns, such wafers are exemplary, and any number of turns may be used.

Figure 1B:
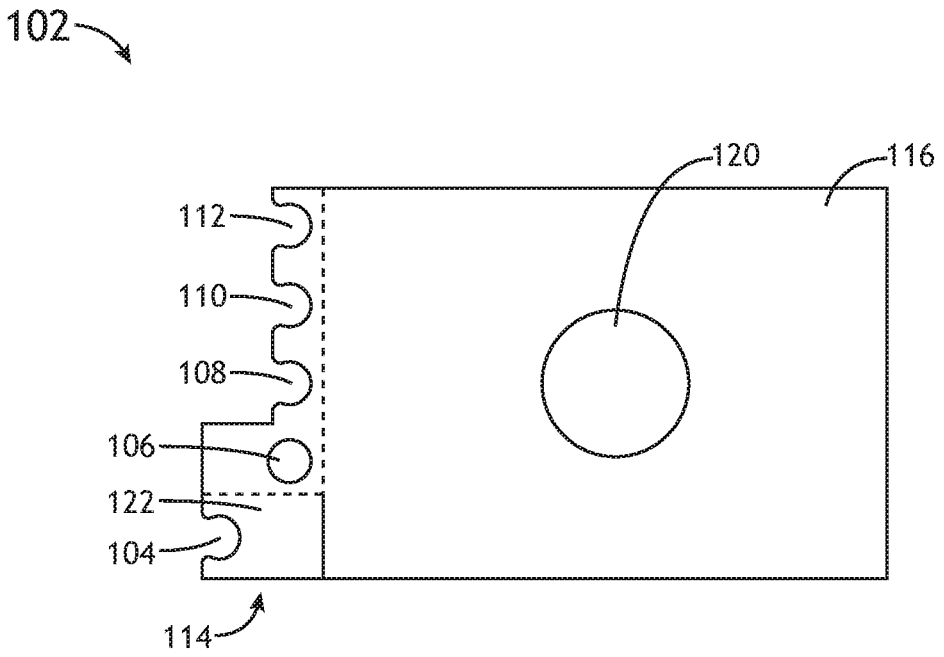
FIG. 1B shows a bottom view of an exemplary embodiment of wafer.

Referring to FIGS. 1A and 1B, a top view and a bottom view of an exemplary embodiment of a wafer are shown. The wafer defines a plurality of edge connection points 104, 106, 108, 110, 112; one or more of the edge connection points 104, 106, 108, 110, 112 may be disposed on or in an edge protrusion 114. The edge protrusion 114 is disposed asymmetrically along a wafer edge.

The first surface 100 and second surface 102 of the wafer each include a conductive layer 116 (such as copper) over a non-conductive core (such as FR4). In at least one embodiment, the conductive layers 116 do not cover the entire surface of the wafer, defining non-conductive portions 118, 122. The non-conductive portions 118, 122 may include some of the edge connection points 104, 106, 108, 110, 112; furthermore, different non-conductive portions 118, 122 may be associated with different edge connection points 104, 106, 108, 110, 112 on opposing sides of the wafer. For example, the copper layer 116 of the first surface 100 extends to a first edge connection point 104, but not to a second edge connection point 106, a third edge connection point 108, a fourth edge connection point 110, and a fifth edge connection point 112. Meanwhile, the copper layer 116 of the second surface 102 extends to the third edge connection point 108, fourth edge connection point 110, and fifth edge connection point 112, but not the first edge connection point 104 or second edge connection point 106.

Asymmetrical features such as edge protrusion 114 disposition and/or copper coverage of the first surface 100 and second surface 102 allow for a plurality of different wiring configurations with the same wafer structure, and a plurality of wafer stack constructions by combining and wiring wafers in different combinations and more fully described herein.

In at least one embodiment, the wafer defines a center hole 120 for a core to facilitate the magnetic features of the wafer and align multiple wafers and their corresponding edge connection points 104, 106, 108, 110, 112.

In at least one embodiment, the first connection point 104 is used in all configurations while the second connection point 106 is not connected to any copper layer 116 and therefore not used in any connections. In at least one embodiment, the second connection point 106 allows for two independent windings by flip-stacking wafers as more fully described herein. The third connection point 108 may comprise a series tap utilized when flip-stacked; the third connection point 108 is utilized to connect windings in series and is connected to the fourth edge connection point 110 and fifth edge connection point 112 on the second surface 102. The fourth connection point 110 and fifth connection point 112 are used for independent winding connections; also, the fourth connection point 110 may be used when flipped stacked.

Sets of wafers according to embodiments of the present disclosure allow for windings to be connected in parallel such that windings share current, offering lower DC resistance/loss. There is no limit on the number of windings connected in parallel, so long as it fits inside the core. A pair of windings may be independent, which is useful for designs requiring cross regulation, transformer reset winding, etc. Alternatively, a pair of windings may be connected in series, allowing for a greater number of turns around the core. Windings may be connected in series with a center-tap; a connection necessary in push-pull converters, split supply designs, etc. Different connection configurations are enabled by the geometry of the edge connection points 104, 106, 108, 110, 112 and the configuration of the wafer stack.

Multiple instances of various wiring configurations described herein can be parallelized for lower resistive losses. For example, if two three-turn wafers are connected in series and center-tapped, multiple instances of that configuration can be connected in parallel.

Figure 2A:
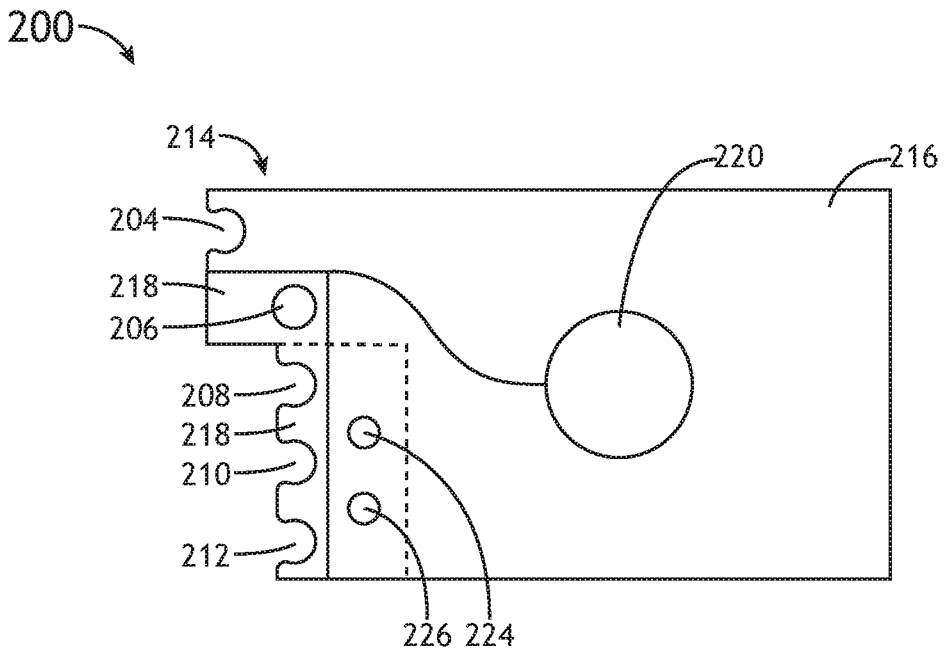
FIG. 2A shows a top view of an exemplary embodiment of wafer.
Figure 2B:
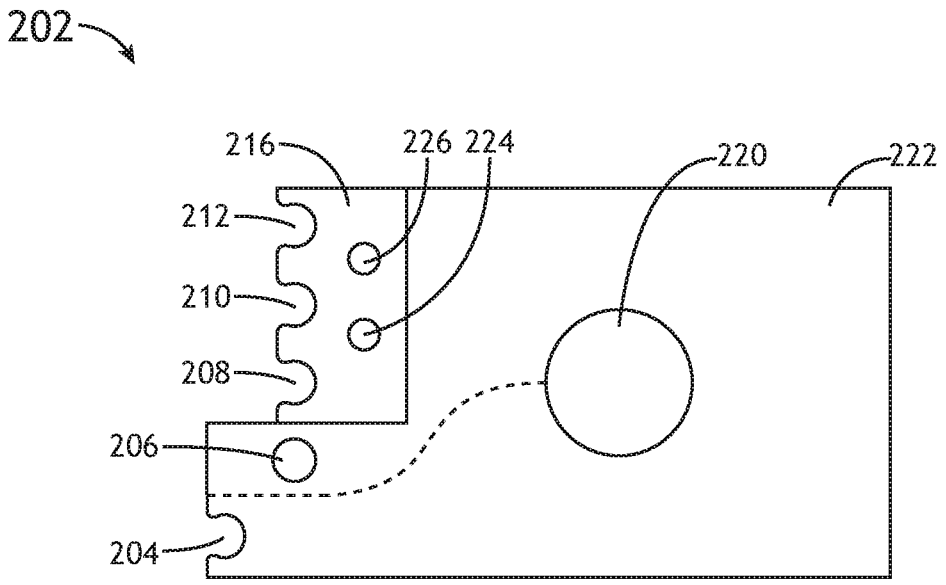
FIG. 2B shows a bottom view of an exemplary embodiment of wafer.

Referring to FIGS. 2A and 2B, a top view and a bottom view of an exemplary embodiment of a wafer are shown. A first surface 200 of the wafer defines a first edge connection point 204, a second edge connection point 206, a third edge connection point 208, a fourth edge connection point 210, and a fifth edge connection point 212. Both the first surface 200 and a second surface 202 include a copper layer 216 for conducting current from one edge connection point 204, 206, 208, 210, 212 to one or more other edge connection points 204, 206, 208, 210, 212. The first surface 200 and second surface 202 also include non-conductive portions 218, 222 to direct current flow around a center hole 220 defined by the wafer. The center hole 220 is configured to receive a core element according to embodiments of a transformer. One or more vias 224, 226 are disposed to connect the copper layers 216 according to the number of windings as more fully described herein. The copper layers 216 of each of the first surface 200 and second surface 202 may define a boundary element 228 splitting the corresponding copper layer 216 to direct current flow around the core, again according to the number of windings. Edge connection points 204, 206, 208, 210, 212 may be characterized as active edge connection points 204, 208, 210, 212, and inactive edge connection points 206. Active edge connection points 204, 208, 210, 212 are utilized for electrical connectivity while inactive edge connection points 206 are not.

In a one-turn configuration, current enters through a connection to the first edge connection point 204 on the first surface 200, travels around the center hole 220, through one or more of the vias 224, 226 to the second surface 202, and exits through one or more of the third edge connection point 208, the fourth edge connection point 210, or the fifth edge connection point 212.

Figure 3A:
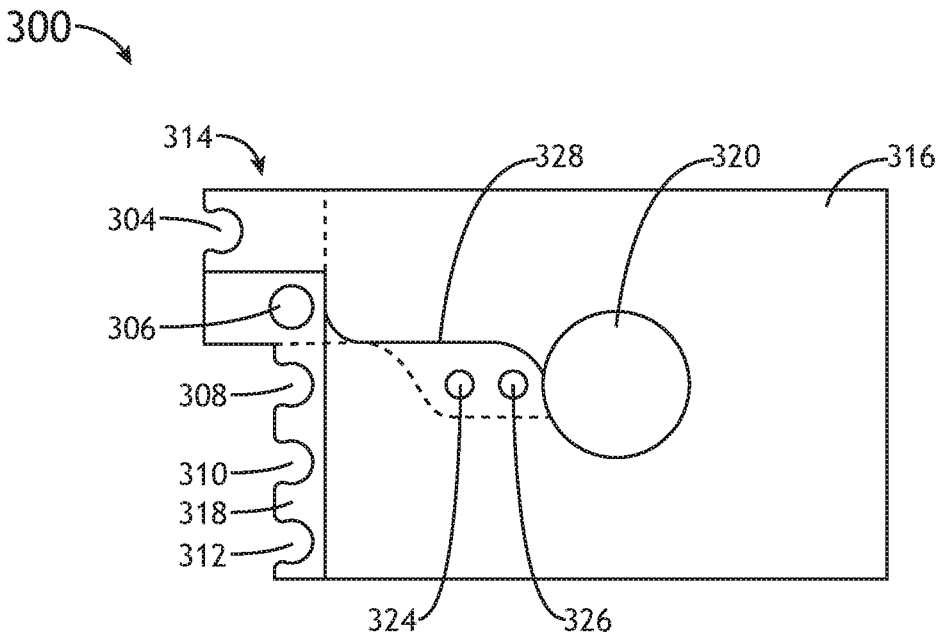
FIG. 3A shows a top view of an exemplary embodiment of wafer.
Figure 3B:
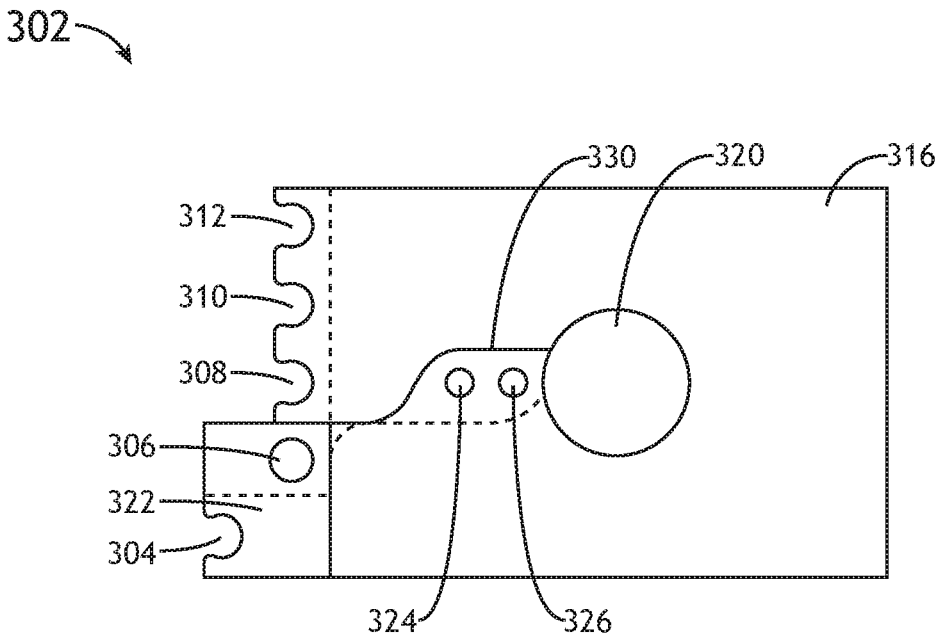
FIG. 3B shows a bottom view of an exemplary embodiment of wafer.

Referring to FIGS. 3A and 3B, a top view and a bottom view of an exemplary embodiment of a wafer are shown. A first surface 300 of the wafer defines a first edge connection point 304, a second edge connection point 306, a third edge connection point 308, a fourth edge connection point 310, and a fifth edge connection point 312. Both the first surface 300 and a second surface 302 include a copper layer 316 for conducting current from one edge connection point 304, 306, 308, 310, 312 to one or more other edge connection points 304, 306, 308, 310, 312. The first surface 300 and second surface 302 also include non-conductive portions 318, 322 to direct current flow around a center hole 320 defined by the wafer. The center hole 320 is configured to receive a core element according to embodiments of a transformer. One or more vias 324, 326 are disposed to connect the copper layers 316 according to the number of windings as more fully described herein. The copper layers 316 of each of the first surface 300 and second surface 302 may define a boundary element 328, 330 splitting the corresponding copper layer 316 to direct current flow around the core, again according to the number of windings. Edge connection points 304, 306, 308, 310, 312 may be characterized as active edge connection points 304, 308, 310, 312, and inactive edge connection points 306. Active edge connection points 304, 308, 310, 312 are utilized for electrical connectivity while inactive edge connection points 306 are not.

In a two-turn configuration, current enters through a connection to the first edge connection point 304 on the first surface 300, travels around the center hole 320, through one or more of the vias 324, 326 to the second surface 302, around the center hole 320 again, and exits through one or more of the third edge connection point 308, the fourth edge connection point 310, or the fifth edge connection point 312. In a two-turn configuration, the vias 324, 326 are disposed on a side of the center hole 320 proximal to the edge connection points 304, 306, 308, 310, 312.

Figure 4A:
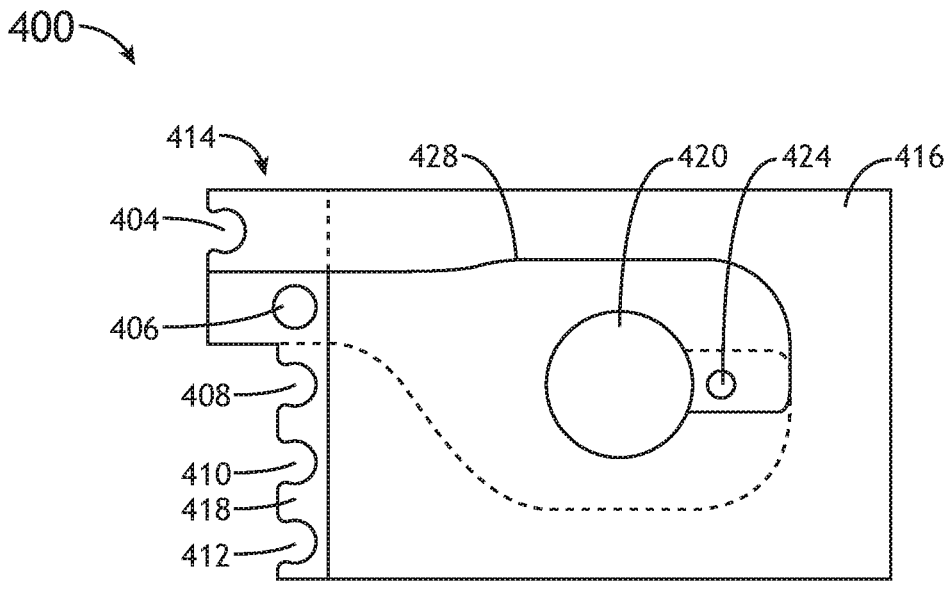
FIG. 4A shows a top view of an exemplary embodiment of wafer.
Figure 4B:
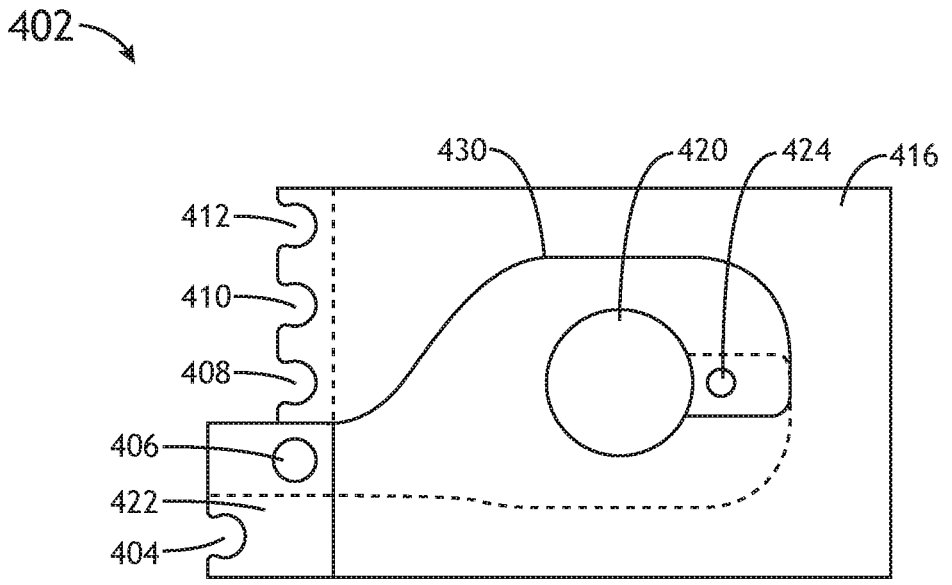
FIG. 4B shows a bottom view of an exemplary embodiment of wafer.

Referring to FIGS. 4A and 4B, a top view and a bottom view of an exemplary embodiment of a wafer are shown. A first surface 400 of the wafer defines a first edge connection point 404, a second edge connection point 406, a third edge connection point 408, a fourth edge connection point 410, and a fifth edge connection point 412. Both the first surface 400 and a second surface 402 include a copper layer 416 for conducting current from one edge connection point 404, 406, 408, 410, 412 to one or more other edge connection points 404, 406, 408, 410, 412. The first surface 400 and second surface 402 also include non-conductive portions 418, 422 to direct current flow around a center hole 420 defined by the wafer. The center hole 420 is configured to receive a core element according to embodiments of a transformer. One or more vias 424 are disposed to connect the copper layers 416 according to the number of windings as more fully described herein. The copper layers 416 of each of the first surface 400 and second surface 402 may define a boundary element 428, 430 splitting the corresponding copper layer 416 to direct current flow around the core, again according to the number of windings. Edge connection points 404, 406, 408, 410, 412 may be characterized as active edge connection points 404, 408, 410, 412, and inactive edge connection points 406. Active edge connection points 404, 408, 410, 412 are utilized for electrical connectivity while inactive edge connection points 406 are not.

In a three-turn configuration, current enters through a connection to the first edge connection point 404 on the first surface 400, travels around the center hole 420 one and a half times, through one or more of the vias 424 to the second surface 402, around the center hole 420 one and a half times again, and exits through one or more of the third edge connection point 408, the fourth edge connection point 410, or the fifth edge connection point 412. In a three-turn configuration, the vias 424 are disposed on a side of the center hole 420 distal to the edge connection points 404, 406, 408, 410, 412.

Figure 5A:
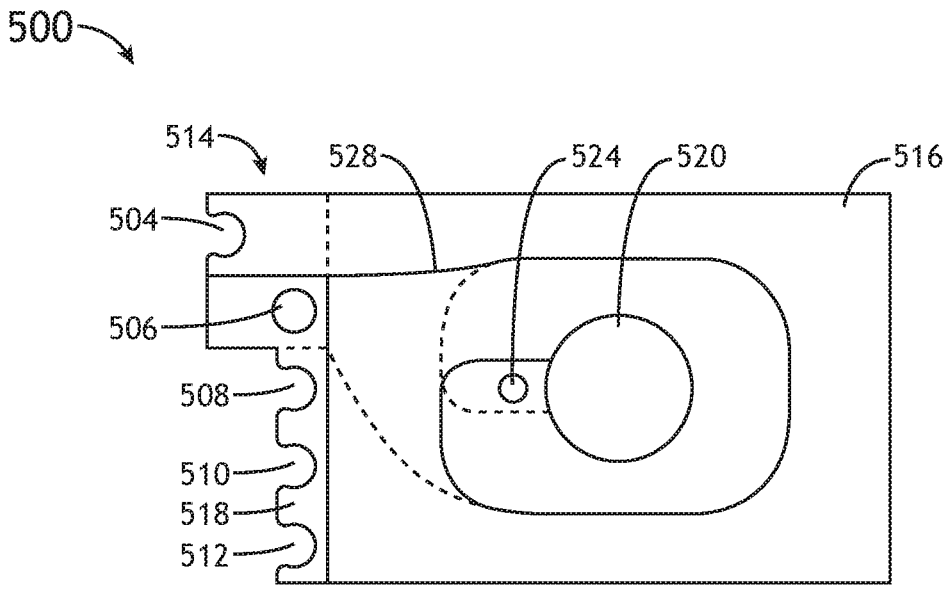
FIG. 5A shows a top view of an exemplary embodiment of wafer.
Figure 5B:
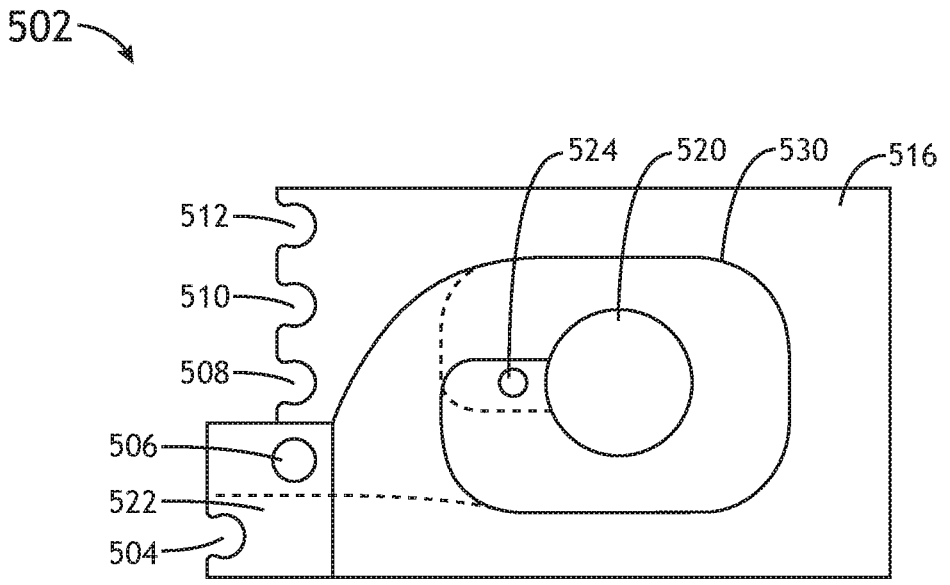
FIG. 5B shows a bottom view of an exemplary embodiment of wafer.

Referring to FIGS. 5A and 5B, a top view and a bottom view of an exemplary embodiment of a wafer are shown. A first surface 500 of the wafer defines a first edge connection point 504, a second edge connection point 506, a third edge connection point 508, a fourth edge connection point 510, and a fifth edge connection point 512. Both the first surface 500 and a second surface 502 include a copper layer 516 for conducting current from one edge connection point 504, 506, 508, 510, 512 to one or more other edge connection points 504, 506, 508, 510, 512. The first surface 500 and second surface 502 also include non-conductive portions 518, 522 to direct current flow around a center hole 520 defined by the wafer. The center hole 520 is configured to receive a core element according to embodiments of a transformer. One or more vias 524 are disposed to connect the copper layers 516 according to the number of windings as more fully described herein. The copper layers 516 of each of the first surface 500 and second surface 502 may define a boundary element 528 splitting the corresponding copper layer 516 to direct current flow around the core, again according to the number of windings. Edge connection points 504, 506, 508, 510, 512 may be characterized as active edge connection points 504, 508, 510, 512, and inactive edge connection points 506. Active edge connection points 504, 508, 510, 512 are utilized for electrical connectivity while inactive edge connection points 506 are not.

In a four-turn configuration, current enters through a connection to the first edge connection point 504 on the first surface 500, travels around the center hole 520 twice, through one or more of the vias 524 to the second surface 502, around the center hole 520 twice again, and exits through one or more of the third edge connection point 508, the fourth edge connection point 510, or the fifth edge connection point 512. In a four-turn configuration, the vias 524 are disposed on a side of the center hole 520 proximal to the edge connection points 505, 506, 508, 510, 512.

In at least one embodiment, a pair of wafers can be connected in series. In a kit of wafers according to the present disclosure, four wafers such as shown in FIGS. 2, 3, 4, and 5, may be used to produce thirty-two unique transformer turn ratios.

Figure 6:
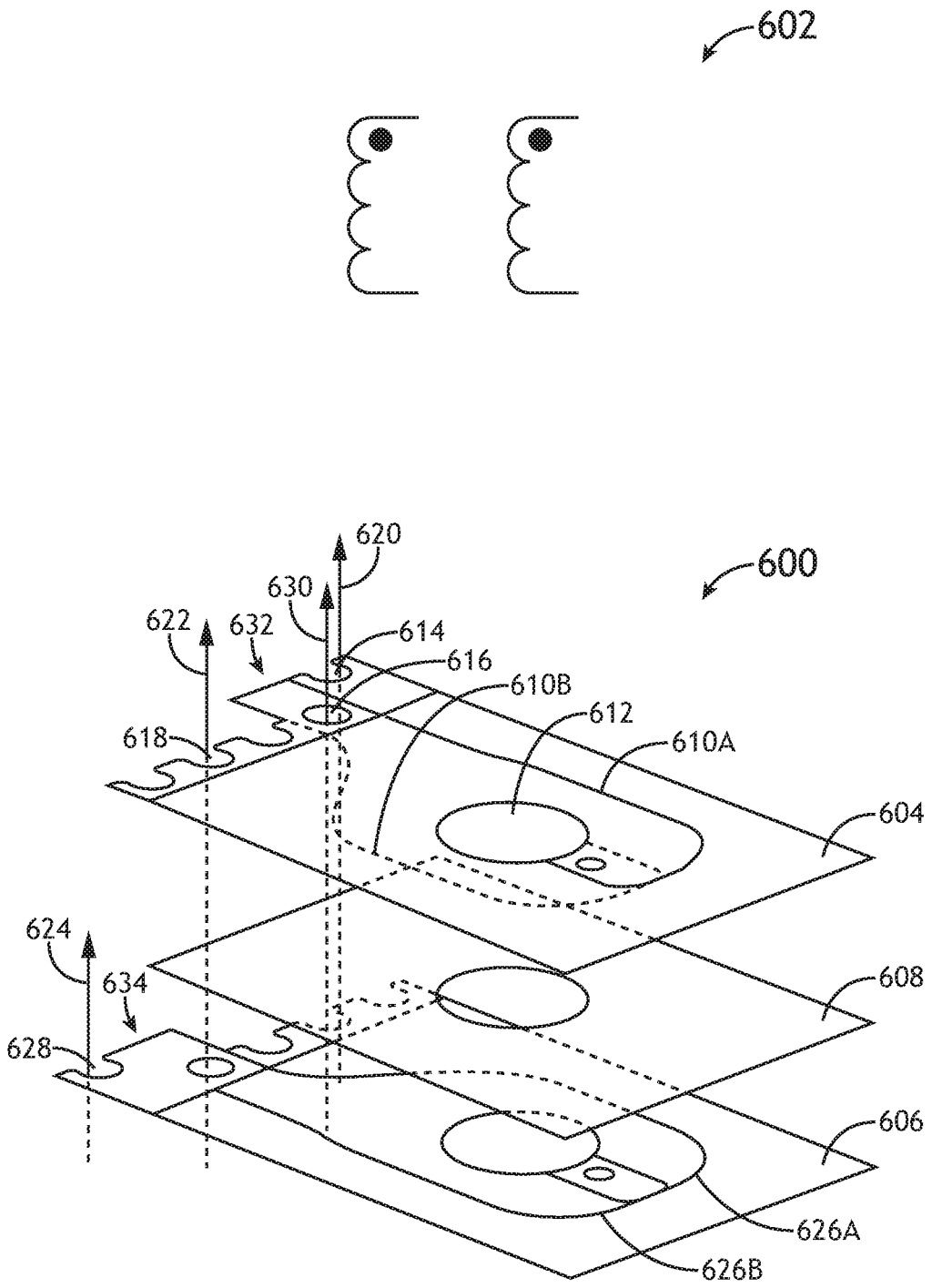
FIG. 6 shows a perspective view of a wafer stack according to an exemplary embodiment.

Referring to FIG. 6, a perspective view of a wafer stack according to an exemplary embodiment is shown. A wafer stack 600 utilizing embodiments of the present disclosure may be used to implement an independent transformer diagram 602. The stack 600 includes a first wafer 604 and a second wafer 606. In at least one embodiment, the stack 600 may also include an insulating layer 608.

Each wafer 604, 606 includes a first copper layer on a first surface and a second copper layer on a second surface. The copper layers may be split by boundary elements 610A, 610B, 626A, 626B; for example, the first surface of the first wafer 604 is split by a first boundary element 610A while the second surface of the first wafer 604 is split by a second boundary element 610B. Likewise, the first surface of the second wafer 606 is split by a first boundary element 626A while the second surface of the second wafer 606 is split by a second boundary element 626B. Each copper layer is split to induce current flow around a center hole 612 defined by each wafer 604, 606.

The first wafer 604 is connected at an active first edge connection point 614 to a first pin 620, and at an active fourth edge connection point 618 to a second pin 622. Meanwhile, the second wafer 606 is connected at an active first edge connection point 628 to a third pin 624, and an active fourth edge connection point (obscured) to a fourth pin 630.

Because of the orientations and asymmetries of the first wafer 604 and second wafer 606, protruding portions 632, 634 of each respective wafer 604, 606 are not aligned. Therefore, the first pin 620 does not connect to the second wafer 606, and the second pin 622 is physically connected to the second wafer 606 via an inactive second edge connection point which does not have electrical connectivity in the second wafer 606. Likewise, the third pin 624 does not connect to the first wafer 604, and the fourth pin 630 is physically connected to the first wafer 604 via an inactive second edge connection point 616 which does not have electrical connectivity in the first wafer 604.

The wafer configuration shows half of a transformer for clarity. In actual application, the pins 620, 622, 624, 630 would be soldered to a printed circuit board. It may be appreciated that wafers 604, 606 having a three-turn configuration (such as in FIGS. 4A and 4B), any winding configurations may be utilized.

Figure 7:
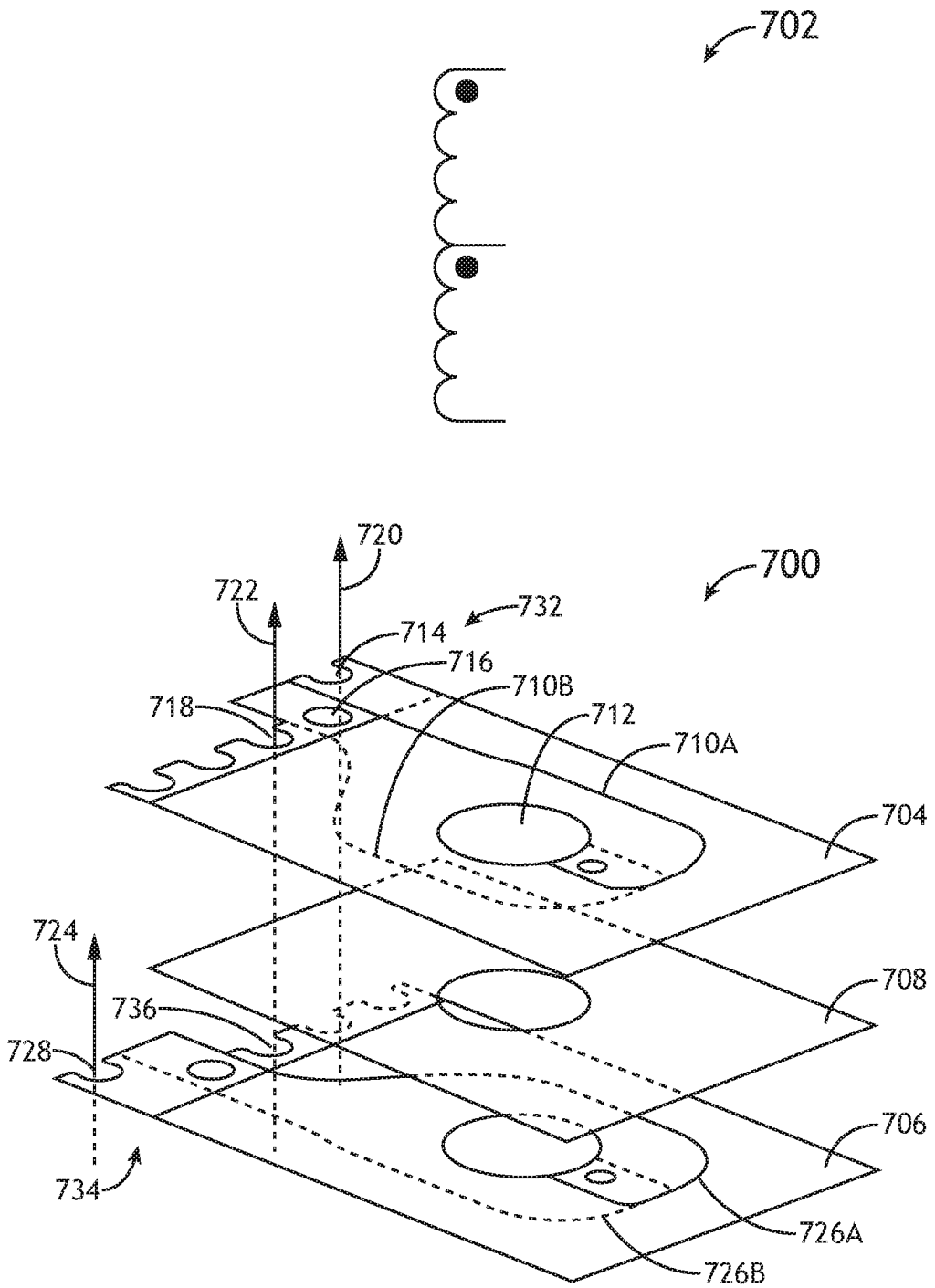
FIG. 7 shows a perspective view of a wafer stack according to an exemplary embodiment.

Referring to FIG. 7, a perspective view of a wafer stack according to an exemplary embodiment is shown. A wafer stack 700 utilizing embodiments of the present disclosure may be used to implement a series transformer with a center-tap diagram 702. The stack 700 includes a first wafer 704 and a second wafer 706. In at least one embodiment, the stack 700 may also include an insulating layer 708. The wafer configuration shows half of a transformer for clarity.

Each wafer 704, 706 includes a first copper layer on a first surface and a second copper layer on a second surface. The copper layers may be split by boundary elements 710A, 710B, 726A, 726B; for example, the first surface of the first wafer 704 is split by a first boundary element 710A while the second surface of the first wafer 704 is split by a second boundary element 710B. Likewise, the first surface of the second wafer 706 is split by a first boundary element 726A while the second surface of the second wafer 706 is split by a second boundary element 726B. Each copper layer is split to induce current flow around a center hole 712 defined by each wafer 704, 706.

The first wafer 704 is connected at an active first edge connection point 714 to a first pin 720, and at an active third edge connection point 718 to a second pin 722. Meanwhile, the second wafer 706 is connected at an active first edge connection point 728 to a third pin 724, and an active third edge connection point 736 to the second pin 722.

Because of the orientations and asymmetries of the first wafer 704 and second wafer 706, protruding portions 732, 734 of each respective wafer 704, 706 are not aligned. Therefore, the first pin 720 does not connect to the second wafer 706 and the third pin 724 does not connect to the first wafer 704. The second pin 722 comprises a shared connection point linking the wafers 704, 706 in series. In actual application, the pins 720, 722, 724 would be soldered to a printed circuit board.

Figure 8:
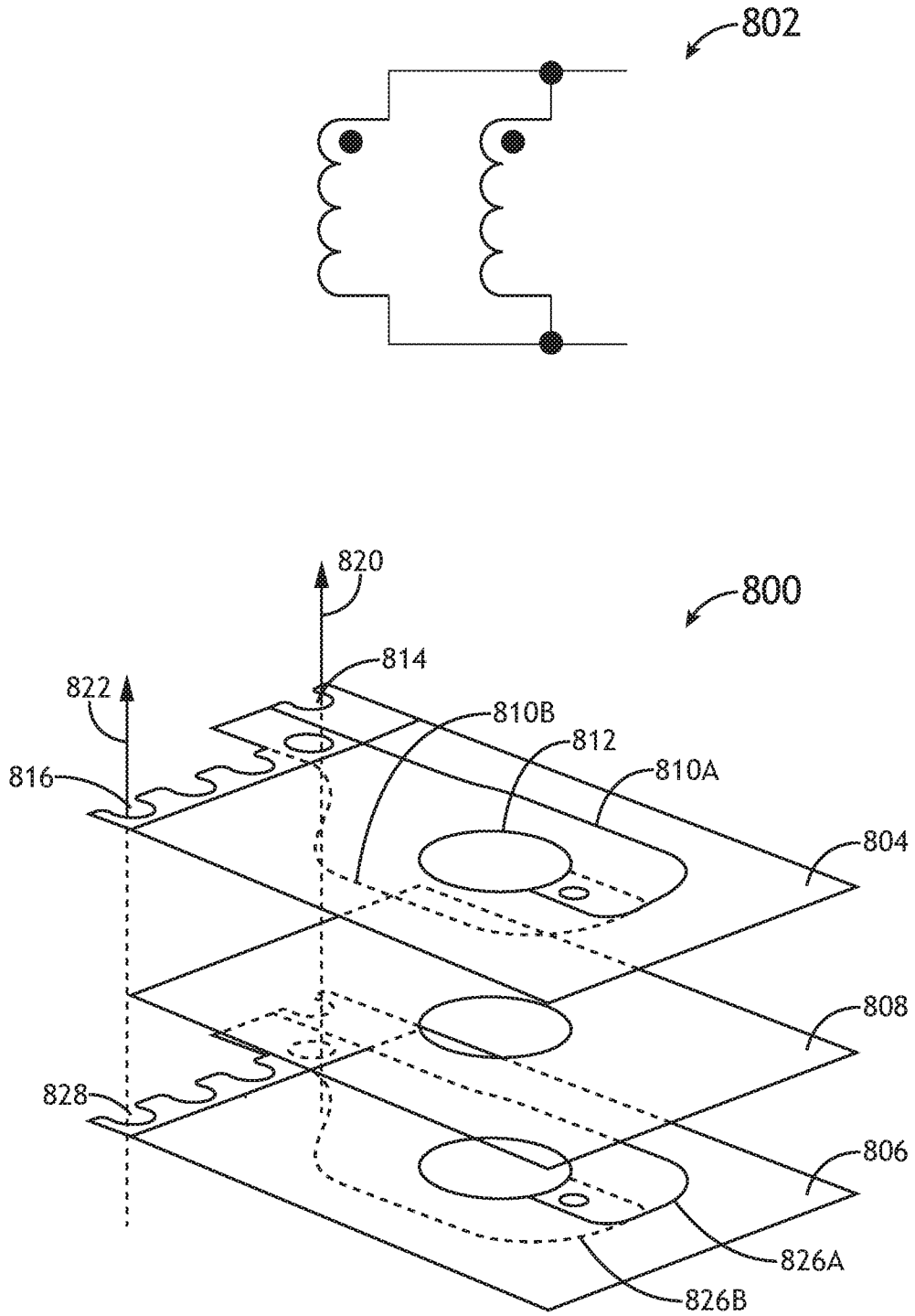
FIG. 8 shows a perspective view of a wafer stack according to an exemplary embodiment.

Referring to FIG. 8, a perspective view of a wafer stack according to an exemplary embodiment is shown. A wafer stack 800 utilizing embodiments of the present disclosure may be used to implement a parallel transformer diagram 802. The stack 800 includes a first wafer 804 and a second wafer 806. In at least one embodiment, the stack 800 may also include an insulating layer 808. The wafer configuration shows half of a transformer for clarity.

Each wafer 804, 806 includes a first copper layer on a first surface and a second copper layer on a second surface. The copper layers may be split by boundary elements 810A, 810B, 826A, 826B; for example, the first surface of the first wafer 804 is split by a first boundary element 810A while the second surface of the first wafer 804 is split by a second boundary element 810B. Likewise, the first surface of the second wafer 806 is split by a first boundary element 826A while the second surface of the second wafer 806 is split by a second boundary element 826B. Each copper layer is split to induce current flow around a center hole 812 defined by each wafer 804, 806.

The first wafer 804 is connected at an active first edge connection point 814 to a first pin 820, and at an active fifth edge connection point 818 to a second pin 822. Meanwhile, the second wafer 806 is connected at an active first edge connection point (obscured) to the first pin 820, and an active fifth edge connection point 828 to the second pin 822. This configuration results in the windings linked in parallel. In actual application, the pins 820, 822 would be soldered to a printed circuit board.

Figure 9:
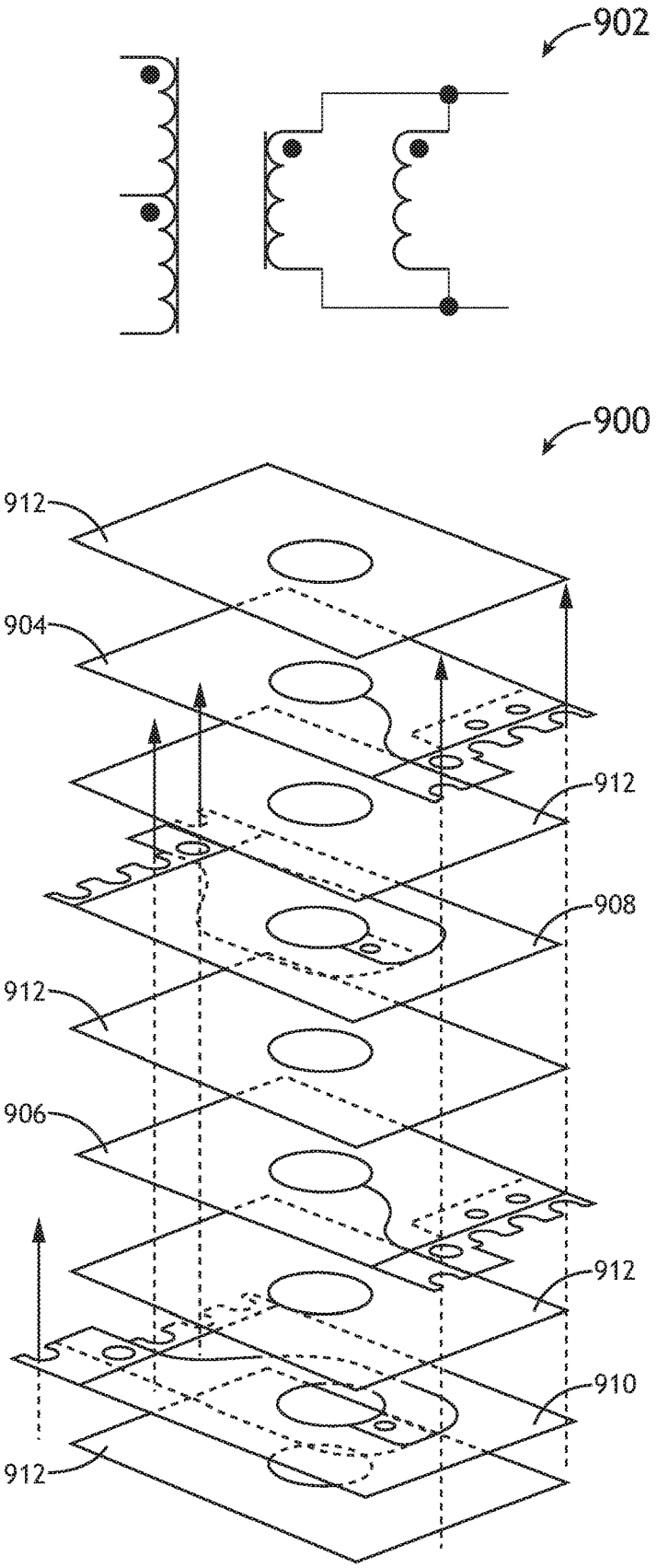
FIG. 9 shows a perspective view of a wafer stack according to an exemplary embodiment.

Referring to FIG. 9, a perspective view of a wafer stack according to an exemplary embodiment is shown. A wafer stack 900 utilizing embodiments of the present disclosure may be used to implement a series center-tap to parallel transformer diagram 902. The parallel portion of the stack 900 includes a first wafer 904 and a second wafer 906 connected in parallel as in FIG. 8; likewise, the series center-tap portion of the stack includes a third wafer 908 and a fourth wafer 910 as in FIG. 7. In at least one embodiment, the stack 800 may also include a plurality of insulating layers 912. The parallel portion wafers 904, 906 are rotated about the center hole (and core) such that the corresponding pins are separate from the pins connected to the series center-tap portion wafers 908, 910.

It will be appreciated that while four wafers 904, 906, 908, 910 are shown, any number of wafers 904, 906, 908, 910 may be utilized according to the application. Likewise, any combination of wafers 904, 906, 908, 910 may be utilized with respect to the number of windings in each respective wafer 904, 906, 908, 910 (for example, as set forth in FIGS. 2A, 2B, 3A, 3B, 4A, 4B, 5A, and 5B).

Furthermore, any configurations of wafers 904, 906, 908, 910 may be utilized (for example, as set forth in FIG. 6, 7, or 8).

Parameters such as inter-winding capacitance and leakage inductance are configurable based on winding stack-up. The designing engineers may finely tune the stack-up for optimal performance in a given application.

The number of wafer permutations needed to support a wide range of transformer turns ratios may be reduced base on winding configurability. A relatively small wafer kit enables a wide range of stack configurations.

Figure 10A:
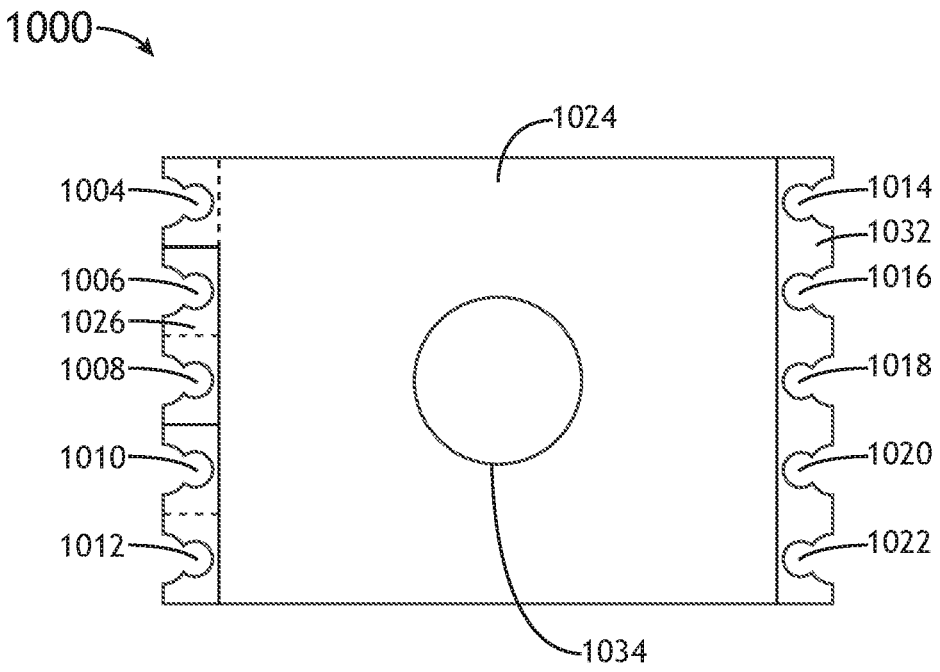
FIG. 10A shows a top view of an exemplary embodiment of wafer.
Figure 10B:
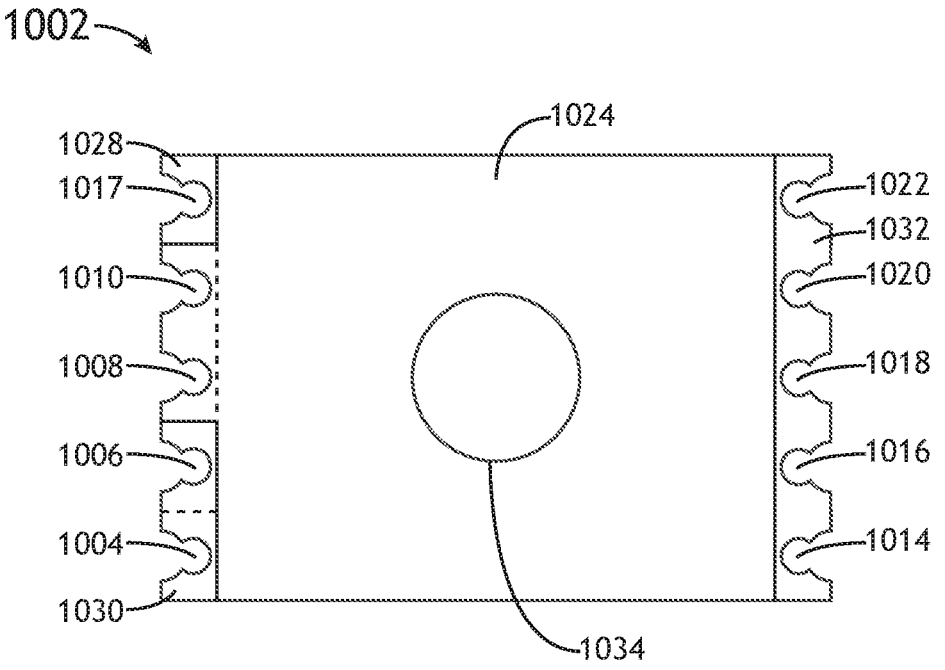
FIG. 10B shows a bottom view of an exemplary embodiment of wafer.

Referring to FIGS. 10A and 10B, a top view and a bottom view of an exemplary embodiment of a wafer are shown. The wafer defines a plurality of active edge connection points 1004, 1008, 1010, and one or more inactive edge connection points 1006, 1012, 1014, 1016, 1018, 1020, 1022.

The first surface 1000 and second surface 1002 of the wafer each include a conductive layer 1024 (such as copper) over a non-conductive core (such as FR4). In at least one embodiment, the conductive layers 1024 do not cover the entire surface of the wafer, defining non-conductive portions 1026, 1028, 1030, 1032. The non-conductive portions 1026, 1028, 1030, 1032 may include some of the active edge connection points 1004, 1008, 1010, furthermore, different non-conductive portions 1026, 1028, 1030, 1032 may be associated with different active edge connection points 1004, 1008, 1010 on opposing sides of the wafer. For example, the copper layer 1024 of the first surface 1000 extends to an active first edge connection point 1004. Meanwhile, the copper layer 1024 of the second surface 1002 extends to an active third edge connection point 1008 and an active fourth edge connection point 1010, but not the active first edge connection point 1004.

Asymmetrical features such as copper coverage of the first surface 1000 and second surface 1002 allow for a plurality of different wiring configurations with the same wafer structure, and a plurality of wafer stack constructions by combining and wiring wafers in different combinations and more fully described herein.

In at least one embodiment, the wafer defines a center hole 1034 for a core to facilitate the magnetic features of the wafer and align multiple wafers and their corresponding active edge connection points 1004, 1008, 1010.

In at least one embodiment, the active first edge connection point 1004 is used in all configurations while the second edge connection point 1006 is not connected to any copper layer 1024 and therefore not used in any connections. In at least one embodiment, the inactive second edge connection point 1006 allows for two independent windings by flip-stacking wafers as more fully described herein, and to allow for an additional solder point for stability. The active third edge connection point 1008 may comprise a series tap utilized when flip-stacked; the active third edge connection point 1008 is utilized to connect windings in series and is connected to the active fourth edge connection point 1010 on the second surface 1002. The active fourth connection point 1010 is used in all configurations. The inactive fifth connection point 1012 has no electronic connection. Other inactive edge connection points 1014, 1016, 1018, 1020, 1022 are not connected to any conductive winding; they allow additional solder points to ease wafer stack construction.

Sets of wafers according to embodiments of the present disclosure allow for windings to be connected in parallel such that windings share current, offering lower DC resistance/loss. There is no limit on the number of windings connected in parallel, so long as it fits inside the core. A pair of windings may be independent, which is useful for designs requiring cross regulation, transformer reset winding, etc. Alternatively, a pair of windings may be connected in series, allowing for a greater number of turns around the core. Windings may be connected in series with a center-tap; a connection necessary in push-pull converters, split supply designs, etc. Different connection configurations are enabled by the geometry of the edge connection points 1004, 1006, 1008, 1010, 1012, 1014, 1016, 1018, 1020, 1022 and the configuration of the wafer stack.

Multiple instances of various wiring configurations described herein can be parallelized for lower resistive losses. For example, if two three-turn wafers are connected in series and center-tapped, multiple instances of that configuration can be connected in parallel.

Figure 11A:
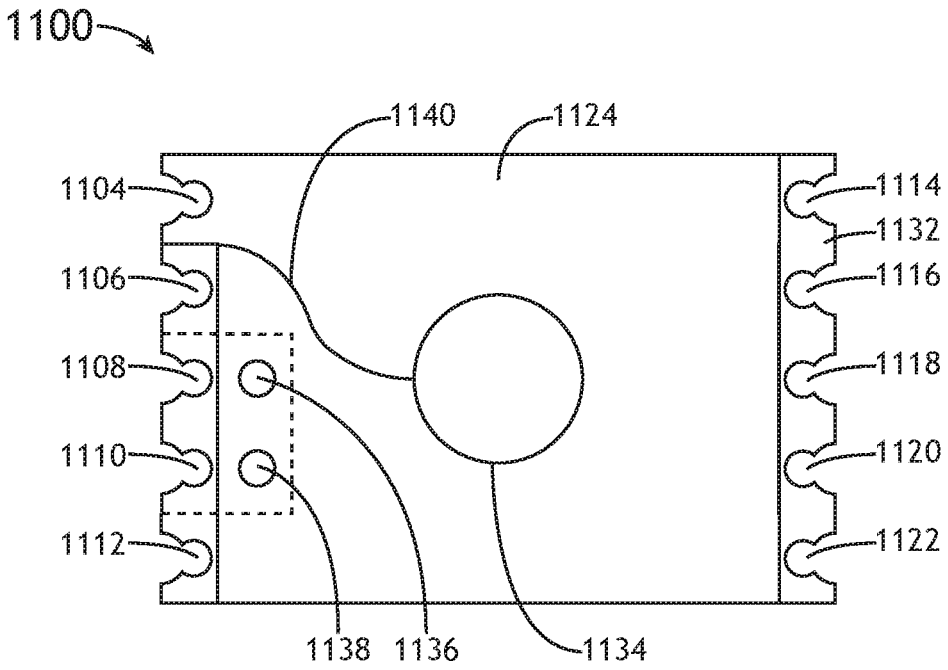
FIG. 11A shows a top view of an exemplary embodiment of wafer.
Figure 11B:
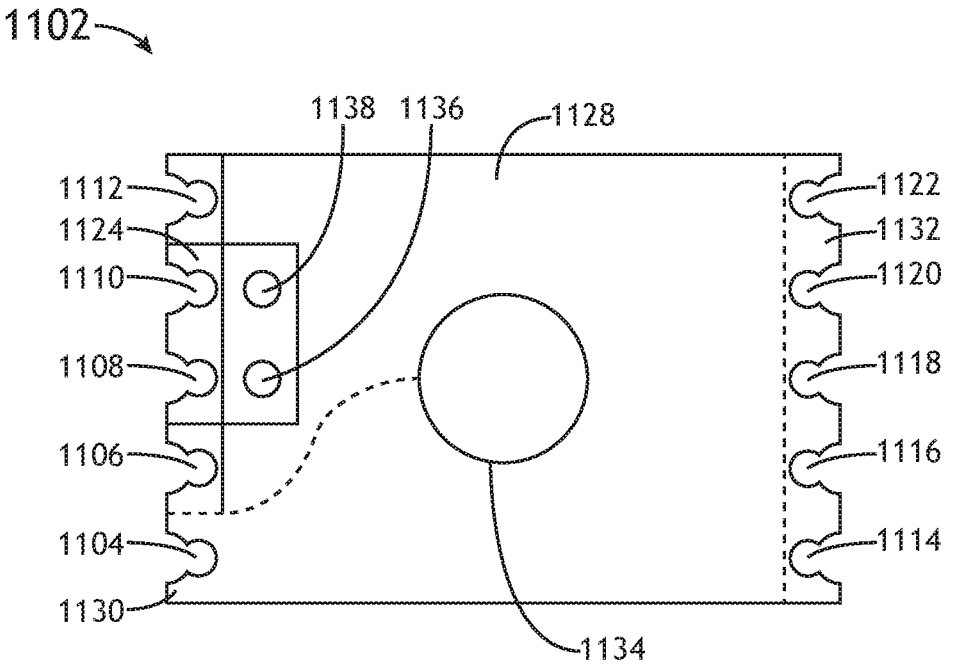
FIG. 11B shows a bottom view of an exemplary embodiment of wafer.

Referring to FIGS. 11A and 11B, a top view and a bottom view of an exemplary embodiment of a wafer are shown. A first surface 1100 and second surface 1102 of the wafer define an active first edge connection point 1104, an active third edge connection point 1108, and an active fourth edge connection point 1110; likewise, the surfaces 1100, 1102 define an inactive second edge connection point 1106, and an inactive fifth edge connection point 1112. Both the first surface 1100 and a second surface 1102 include a copper layer 1116 for conducting current from one active edge connection point 1104, 1108, 1110, to one or more other active edge connection points 1104, 1108, 1110. The first surface 1100 and second surface 1102 also include non-conductive portions 1126, 1128, 1132 to direct current flow around a center hole 1134 defined by the wafer. The center hole 1134 is configured to receive a core element according to embodiments of a transformer. One or more vias 1136, 1138 are disposed to connect the copper layers 1124 according to the number of windings as more fully described herein. The copper layers 1124 of each of the first surface 1100 and second surface 1102 may define a boundary element 1140 splitting the corresponding copper layer 1124 to direct current flow around the core, again according to the number of windings.

In a one-turn configuration, current enters through a connection to the active first edge connection point 1104 on the first surface 1100, travels around the center hole 1134, through one or more of the vias 1136, 1138 to the second surface 1102, and exits through one or more of the active third edge connection point 1108, or the active fourth edge connection point 1110.

In at least one embodiment, the wafer includes a plurality of other inactive edge connection points 1114, 1116, 1118, 1120, 1122. These other inactive edge connection points 1114, 1116, 1118, 1120, 1122 allow for additional soldering points for wafer stack stability.

Figure 12A:
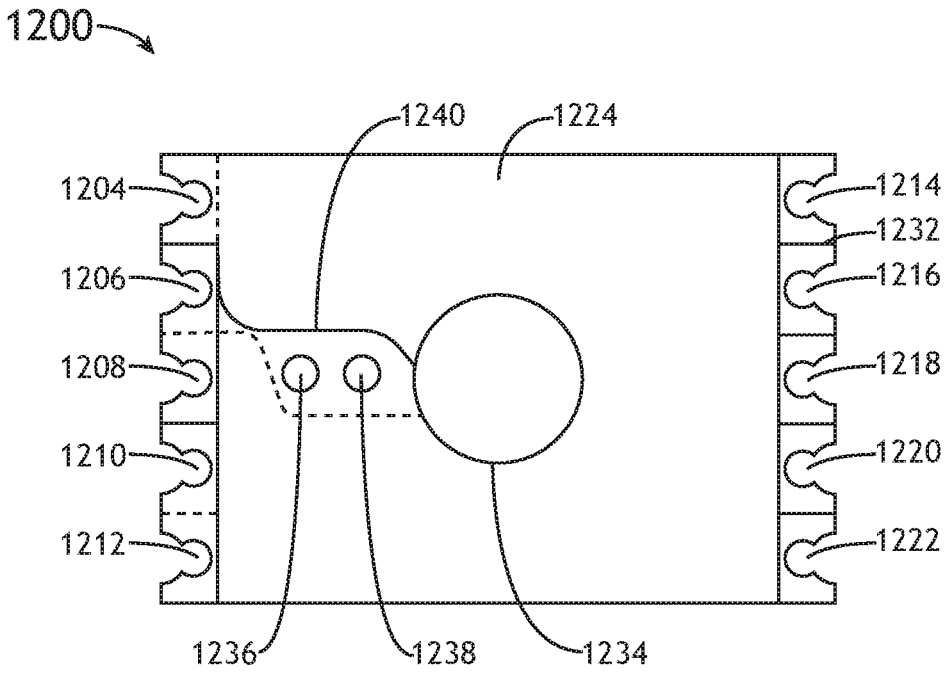
FIG. 12A shows a top view of an exemplary embodiment of wafer.
Figure 12B:
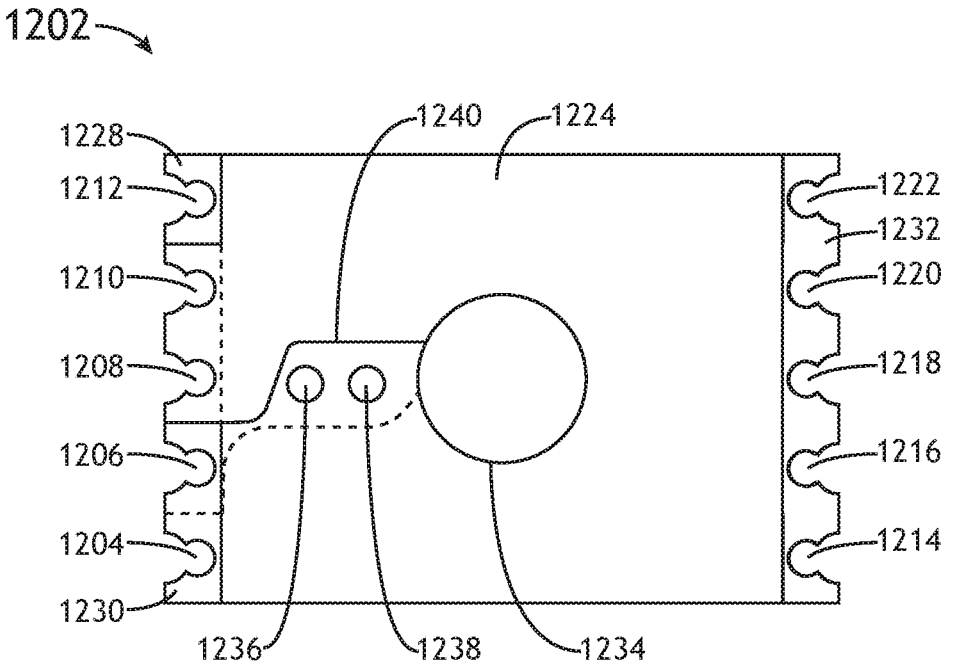
FIG. 12B shows a bottom view of an exemplary embodiment of wafer.

Referring to FIGS. 12A and 12B, a top view and a bottom view of an exemplary embodiment of a wafer are shown. A first surface 1200 and second surface 1202 of the wafer define an active first edge connection point 1204, an active third edge connection point 1208, and an active fourth edge connection point 1210; likewise, the surfaces 1200, 1202 define an inactive second edge connection point 1206, and an inactive fifth edge connection point 1212. Both the first surface 1200 and a second surface 1202 include a copper layer 1224 for conducting current from one active edge connection point 1204, 1208, 1210 to one or more other active edge connection points 1204, 1208, 1210. The first surface 1200 and second surface 1202 also include non-conductive portions 1226, 1228, 1230, 1232 to direct current flow around a center hole 1234 defined by the wafer. The center hole 1234 is configured to receive a core element according to embodiments of a transformer. One or more vias 1236, 1238 are disposed to connect the copper layers 1224 according to the number of windings as more fully described herein. The copper layers 1224 of each of the first surface 1200 and second surface 1202 may define a boundary element 1240 splitting the corresponding copper layer 1224 to direct current flow around the core, again according to the number of windings.

In a two-turn configuration, current enters through a connection to the active first edge connection point 1204 on the first surface 1200, travels around the center hole 1234, through one or more of the vias 1236, 1238 to the second surface 1202, around the center hole 1234 again, and exits through one or more of the active third edge connection point 1208, or the active fourth edge connection point 1210. In a two-turn configuration, the vias 1236, 1238 are disposed on a side of the center hole 1234 proximal to the active edge connection points 1204, 1208, 1210.

In at least one embodiment, the wafer includes a plurality of other inactive edge connection points 1214, 1216, 1218, 1220, 1222. These other inactive edge connection points 1214, 1216, 1218, 1220, 1222 allow for additional soldering points for wafer stack stability.

Figure 13A:
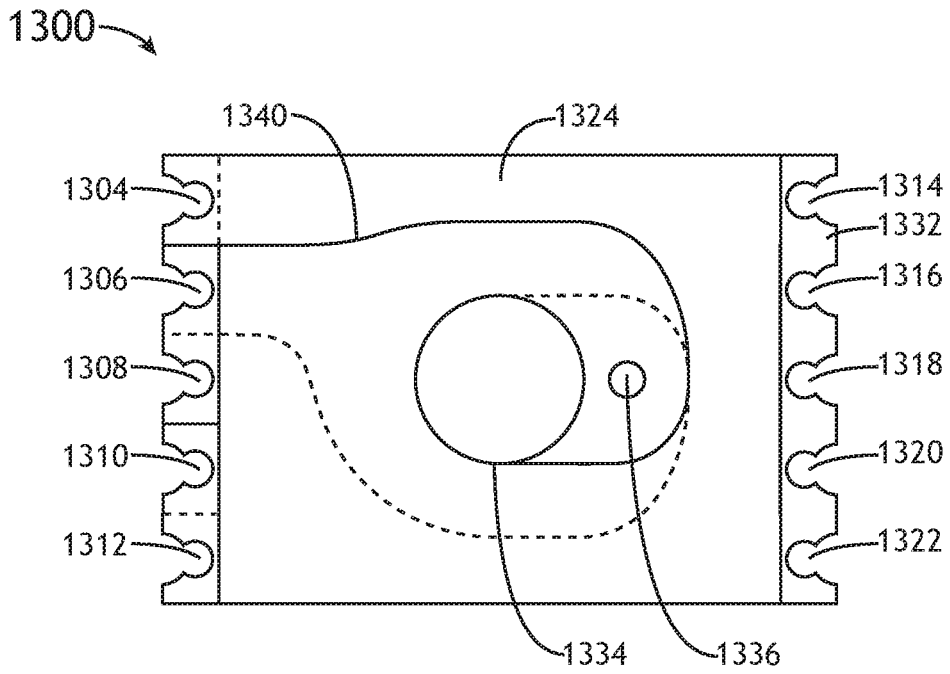
FIG. 13A shows a top view of an exemplary embodiment of wafer.
Figure 13B:
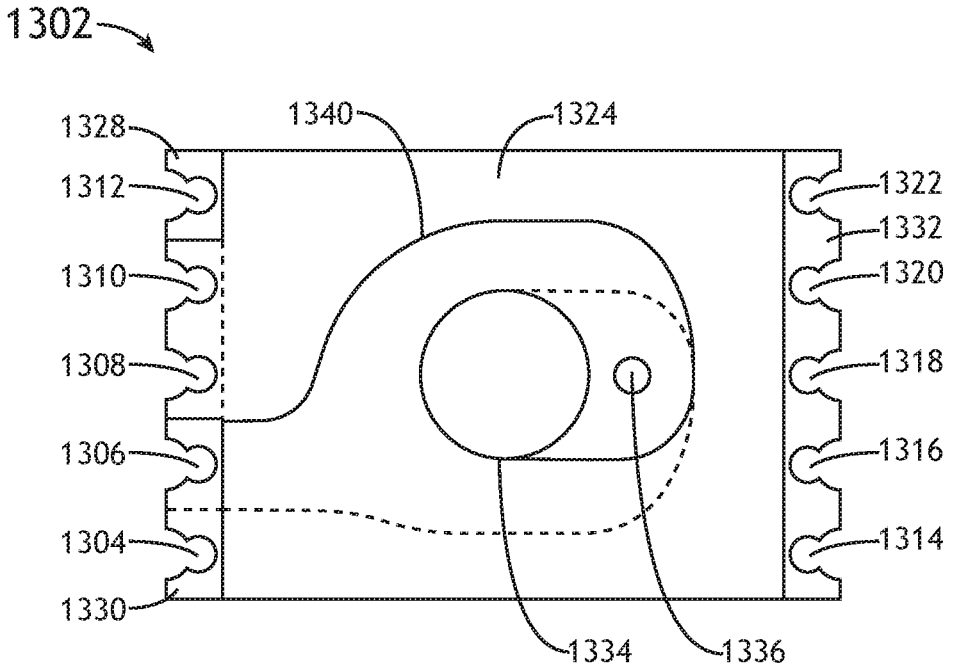
FIG. 13B shows a bottom view of an exemplary embodiment of wafer.

Referring to FIGS. 13A and 13B, a top view and a bottom view of an exemplary embodiment of a wafer are shown. A first surface 1300 and second surface 1302 of the wafer define an active first edge connection point 1304, an active third edge connection point 1308, and an active fourth edge connection point 1310; likewise, the surfaces 1300, 1302 define an inactive second edge connection point 1306, and an inactive fifth edge connection point 1312. Both the first surface 1300 and a second surface 1302 include a copper layer 1324 for conducting current from one active edge connection point 1304, 1308, 1310, to one or more other active edge connection points 1304, 1308, 1310. The first surface 1300 and second surface 1302 also include non-conductive portions 1326, 1328, 1330, 1332 to direct current flow around a center hole 1334 defined by the wafer. The center hole 1334 is configured to receive a core element according to embodiments of a transformer. One or more vias 1336, 1338 are disposed to connect the copper layers 1324 according to the number of windings as more fully described herein. The copper layers 1324 of each of the first surface 1300 and second surface 1302 may define a boundary element 1340 splitting the corresponding copper layer 1324 to direct current flow around the core, again according to the number of windings.

In a three-turn configuration, current enters through a connection to the active first edge connection point 1304 on the first surface 1300, travels around the center hole 1334 one and a half times, through one or more of the vias 1336, 1338 to the second surface 1302, around the center hole 1334 one and a half times again, and exits through one or more of the active third edge connection point 1308, or the active fourth edge connection point 1310. In a three-turn configuration, the vias 1336, 1338 are disposed on a side of the center hole 1334 distal to the active edge connection points 1304, 1308, 1310.

In at least one embodiment, the wafer includes a plurality of other inactive edge connection points 1314, 1316, 1318, 1320, 1322. These other inactive edge connection points 1314, 1316, 1318, 1320, 1322 allow for additional soldering points for wafer stack stability.

Figure 14A:
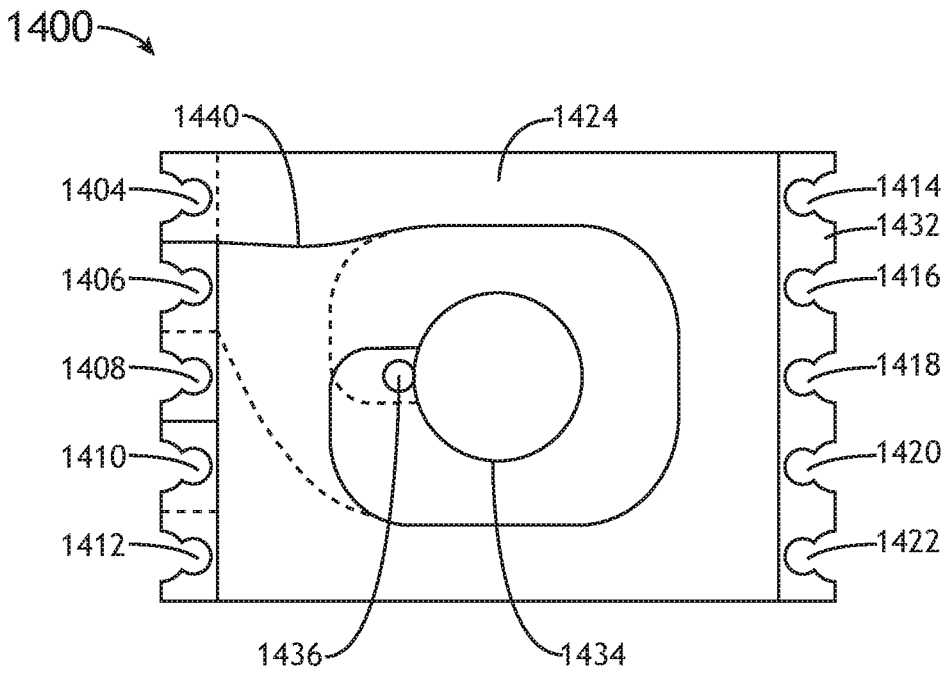
FIG. 14A shows a top view of an exemplary embodiment of wafer.
Figure 14B:
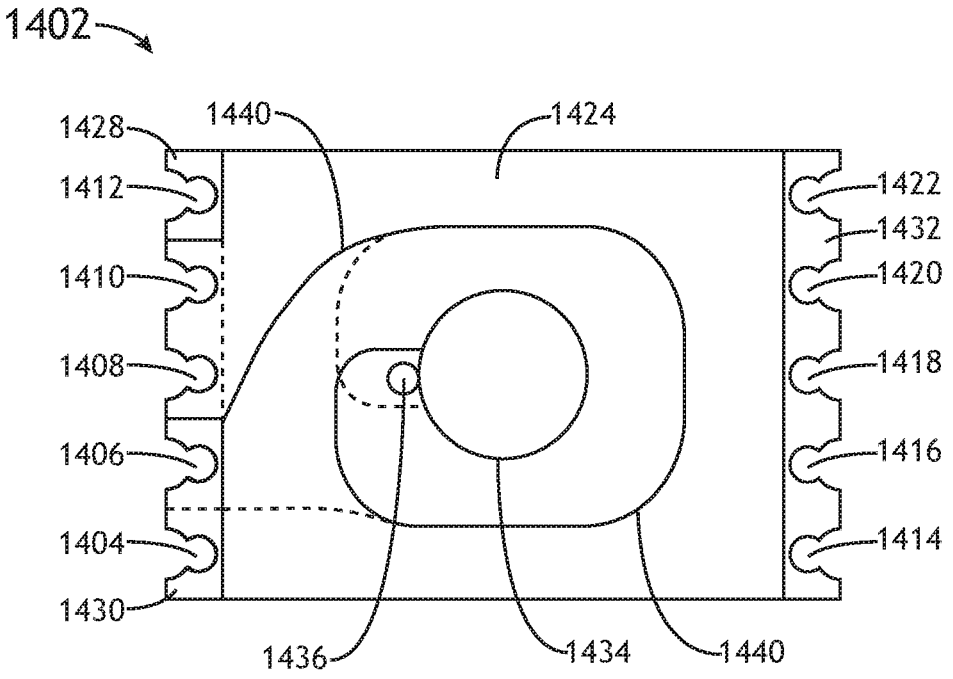
FIG. 14B shows a bottom view of an exemplary embodiment of wafer.

Referring to FIGS. 14A and 14B, a top view and a bottom view of an exemplary embodiment of a wafer are shown. A first surface 1400 and second surface 1402 of the wafer define an active first edge connection point 1404, an active third edge connection point 1408, and an active fourth edge connection point 1410; likewise, the surfaces 1400, 1402 define an inactive second edge connection point 1406, and an inactive fifth edge connection point 1412. Both the first surface 1400 and a second surface 1402 include a copper layer 1424 for conducting current from one active edge connection point 1404, 1408, 1410 to one or more other active edge connection points 1404, 1408, 1410. The first surface 1400 and second surface 1402 also include non-conductive portions 1426, 1428, 1430, 1432 to direct current flow around a center hole 1434 defined by the wafer. The center hole 1434 is configured to receive a core element according to embodiments of a transformer. One or more vias 1436, 1438 are disposed to connect the copper layers 1424 according to the number of windings as more fully described herein. The copper layers 1424 of each of the first surface 1400 and second surface 1402 may define a boundary element 1440 splitting the corresponding copper layer 1424 to direct current flow around the core, again according to the number of windings.

In a four-turn configuration, current enters through a connection to the active first edge connection point 1404 on the first surface 1400, travels around the center hole 1434 two times, through one or more of the vias 1436, 1438 to the second surface 1402, around the center hole 1434 two times again, and exits through one or more of the active third edge connection point 1408, or the active fourth edge connection point 1410. In a four-turn configuration, the vias 1436, 1438 are disposed on a side of the center hole 1434 proximal to the active edge connection points 1404, 1408, 1410.

In at least one embodiment, the wafer includes a plurality of other inactive edge connection points 1414, 1416, 1418, 1420, 1422. These other inactive edge connection points 1414, 1416, 1418, 1420, 1422 allow for additional soldering points for wafer stack stability.

In at least one embodiment, a pair of wafers can be connected in series. In a kit of wafers according to the present disclosure, four wafers such as shown in FIGS. 11, 12, 13, and 14, may be used to produce thirty-two unique transformer turn ratios.

Figure 15:
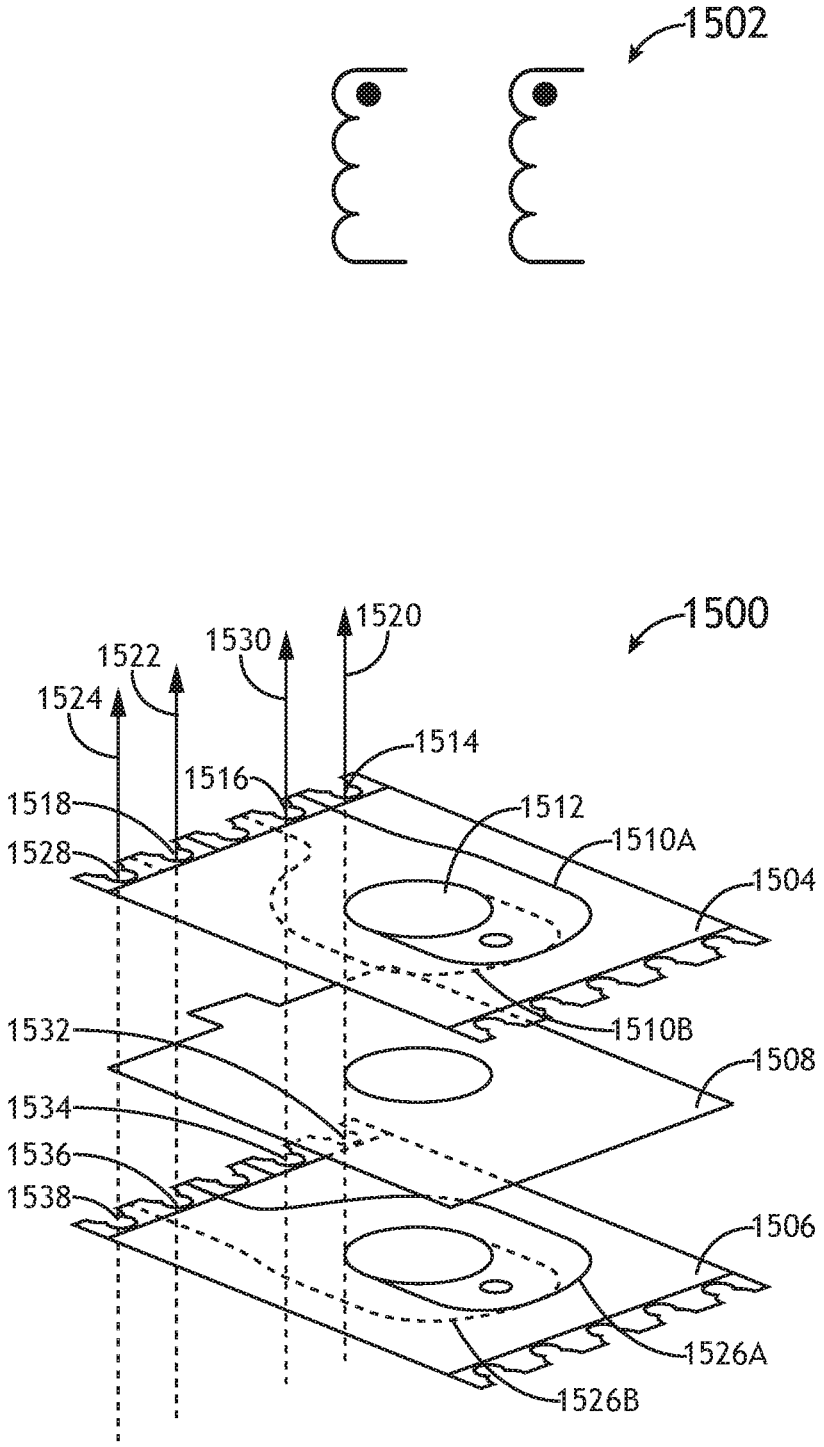
FIG. 15 shows a perspective view of a wafer stack according to an exemplary embodiment.

Referring to FIG. 15, a perspective view of a wafer stack according to an exemplary embodiment is shown. A wafer stack 1500 utilizing embodiments of the present disclosure may be used to implement an independent transformer diagram 1502. The stack 1500 includes a first wafer 1504 and a second wafer 1506. In at least one embodiment, the stack 1500 may also include an insulating layer 1508. The wafer configuration shows half of a transformer for clarity.

Each wafer 1504, 1506 includes a first copper layer on a first surface and a second copper layer on a second surface. The copper layers may be split by boundary elements 1510A, 1510B, 1526A, 1526B; for example, the first surface of the first wafer 1504 is split by a first boundary element 1510A while the second surface of the first wafer 1504 is split by a second boundary element 1510B. Likewise, the first surface of the second wafer 1506 is split by a first boundary element 1526A while the second surface of the second wafer 1506 is split by a second boundary element 1526B. Each copper layer is split to induce current flow around a center hole 1512 defined by each wafer 1504, 1506.

The first wafer 1504 is connected at an active first edge connection point 1514 to a first pin 1520, at an active fourth edge connection point 1518 to a second pin 1522, at an inactive fifth edge connection point 1528 to a third pin 1524, and at an inactive second edge connection point 1516 to a fourth pin 1530. Meanwhile, the second wafer 1506 is connected at an active first edge connection point 1538 to the third pin 1524, at an active fourth edge connection point 1534 to the fourth pin 1530, at an inactive fifth edge connection point 1532 to the first pin 1520, and at an inactive second edge connection point 1536 to the second pin 1522.

Because of their orientations and asymmetries, the copper layers of each respective wafer 1504, 1506 are not aligned. The first pin 1520 and second pin 1522 do not have electrical connectivity in the second wafer 1506. Likewise, the third pin 1524 and fourth pin 1530 do not have electrical connectivity in the first wafer 1504.

In actual application, the pins 1520, 1522, 1524, 1530 would be soldered to a printed circuit board. It may be appreciated that while wafers 1504, 1506 having a three-turn configuration (such as in FIGS. 13A and 13B) are shown, any winding configurations may be utilized.

Figure 16:
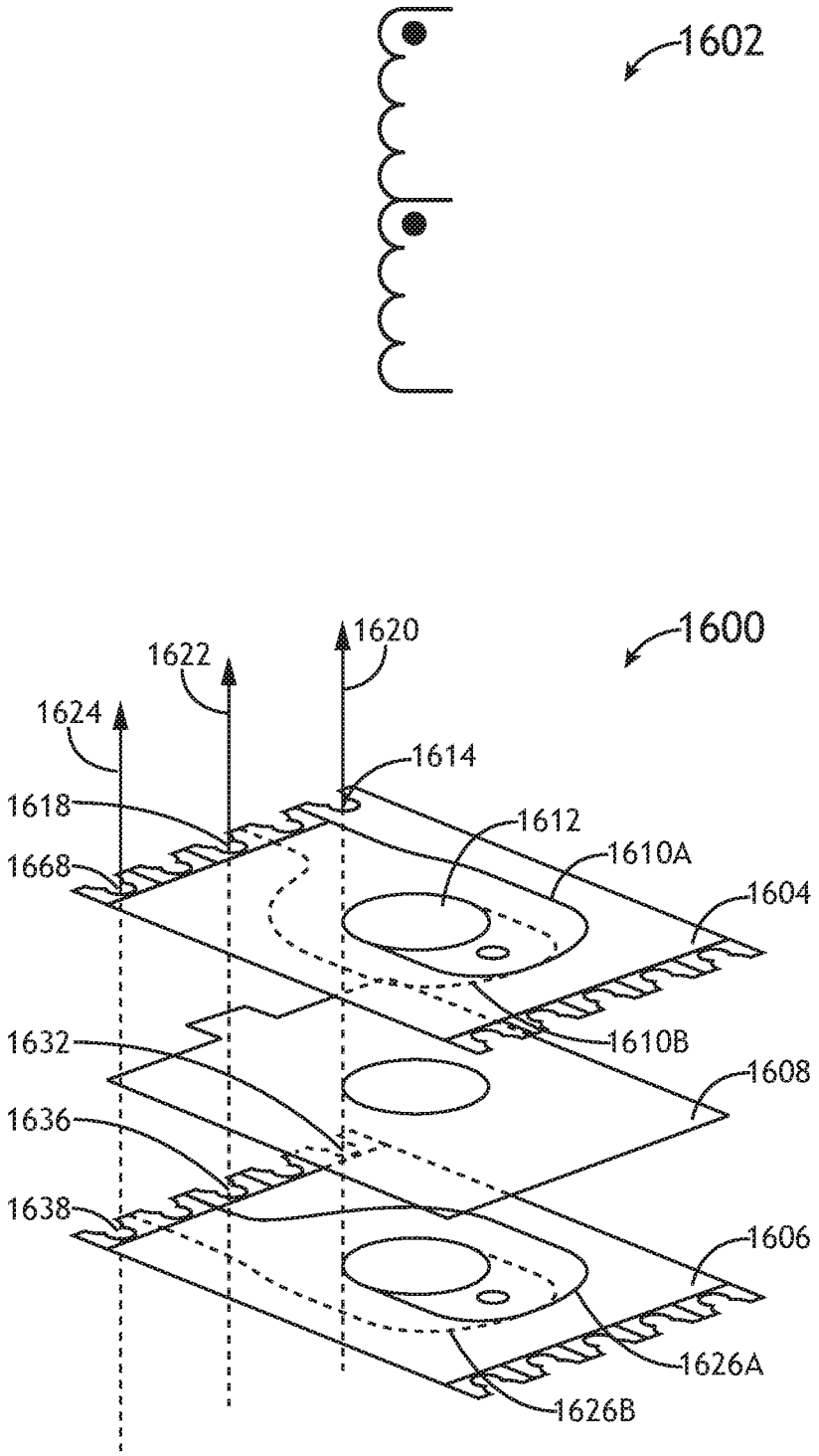
FIG. 16 shows a perspective view of a wafer stack according to an exemplary embodiment.

Referring to FIG. 16, a perspective view of a wafer stack according to an exemplary embodiment is shown. A wafer stack 1600 utilizing embodiments of the present disclosure may be used to implement a series transformer with a center-tap diagram 1602. The stack 1600 includes a first wafer 1604 and a second wafer 1606. In at least one embodiment, the stack 1600 may also include an insulating layer 1608. The wafer configuration shows half of a transformer for clarity.

Each wafer 1604, 1606 includes a first copper layer on a first surface and a second copper layer on a second surface. The copper layers may be split by boundary elements 1610A, 1610B, 1626A, 1626B; for example, the first surface of the first wafer 1604 is split by a first boundary element 1610A while the second surface of the first wafer 1604 is split by a second boundary element 1610B. Likewise, the first surface of the second wafer 1606 is split by a first boundary element 1626A while the second surface of the second wafer 1606 is split by a second boundary element 1626B. Each copper layer is split to induce current flow around a center hole 1612 defined by each wafer 1604, 1606.

The first wafer 1604 is connected at an active first edge connection point 1614 to a first pin 1620, at an active third edge connection point 1618 to a second pin 1622, and at an inactive fifth edge connection point 1628 to a third pin 1624. Meanwhile, the second wafer 1606 is connected at an active first edge connection point 1638 to the third pin 1624, an active third edge connection point 1636 to the second pin 1622, and at the inactive fifth edge connection point 1632 to the first pin 1620.

Because of their orientations and asymmetries, the copper layers of each respective wafer 1604, 1606 are not aligned. Therefore, the first pin 1620 does not have electrical connectivity to the second wafer 1606 and the third pin 1624 does not have electrical connectivity to the first wafer 1604. The second pin 1622 comprises a shared connection point linking the wafers 1604, 1606 in series.

In actual application, the pins 1620, 1622, 1624 would be soldered to a printed circuit board.

Figure 17:
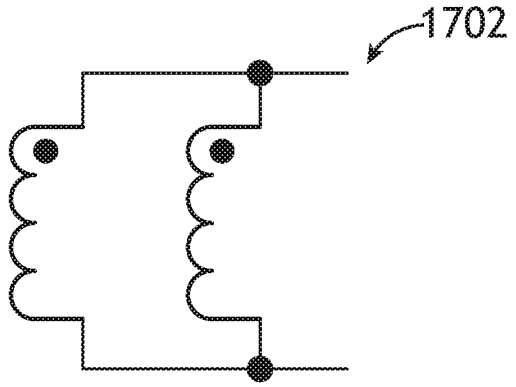
FIG. 17 shows a perspective view of a wafer stack according to an exemplary embodiment.
Figure 17:
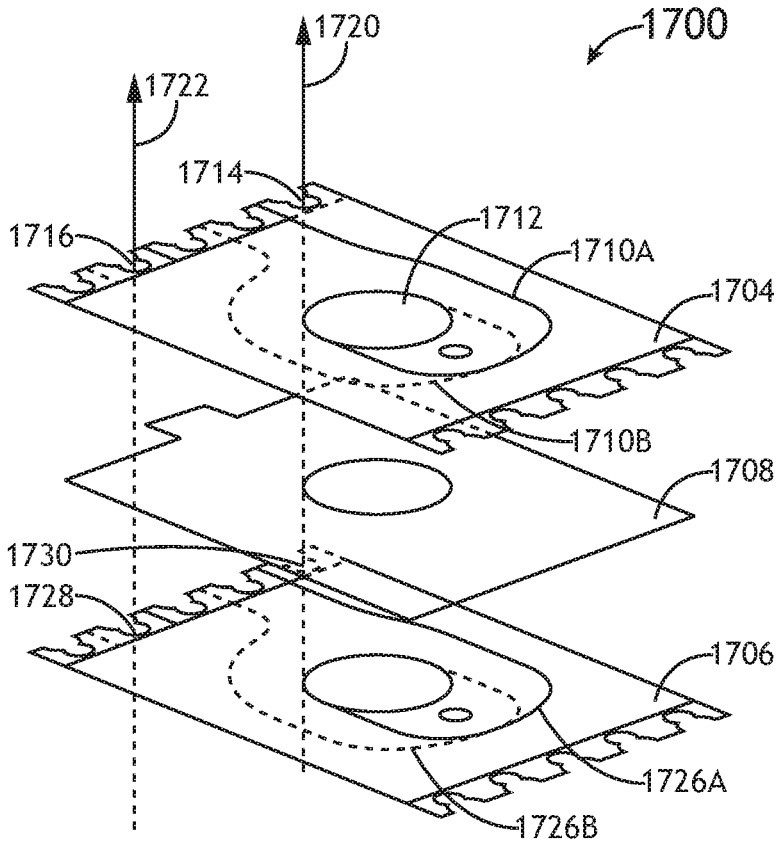

Referring to FIG. 17, a perspective view of a wafer stack according to an exemplary embodiment is shown. A wafer stack 1700 utilizing embodiments of the present disclosure may be used to implement a parallel transformer diagram 1702. The stack 1700 includes a first wafer 1704 and a second wafer 1706. In at least one embodiment, the stack 1700 may also include an insulating layer 1708. The wafer configuration shows half of a transformer for clarity.

Each wafer 1704, 1706 includes a first copper layer on a first surface and a second copper layer on a second surface. The copper layers may be split by boundary elements 1710A, 1710B, 1726A, 1726B; for example, the first surface of the first wafer 1704 is split by a first boundary element 1710A while the second surface of the first wafer 1704 is split by a second boundary element 1710B. Likewise, the first surface of the second wafer 1706 is split by a first boundary element 1726A while the second surface of the second wafer 1706 is split by a second boundary element 1726B. Each copper layer is split to induce current flow around a center hole 1712 defined by each wafer 1704, 1706.

The first wafer 1704 is connected at an active first edge connection point 1714 to a first pin 1720, and at an active fourth edge connection point 1716 to a second pin 1722. Meanwhile, the second wafer 1706 is connected at an active first edge connection point 1730 to the first pin 1720, and an active fourth edge connection point 1728 to the second pin 1722.

In actual application, the pins 1720, 1722 would be soldered to a printed circuit board.

Figure 18:
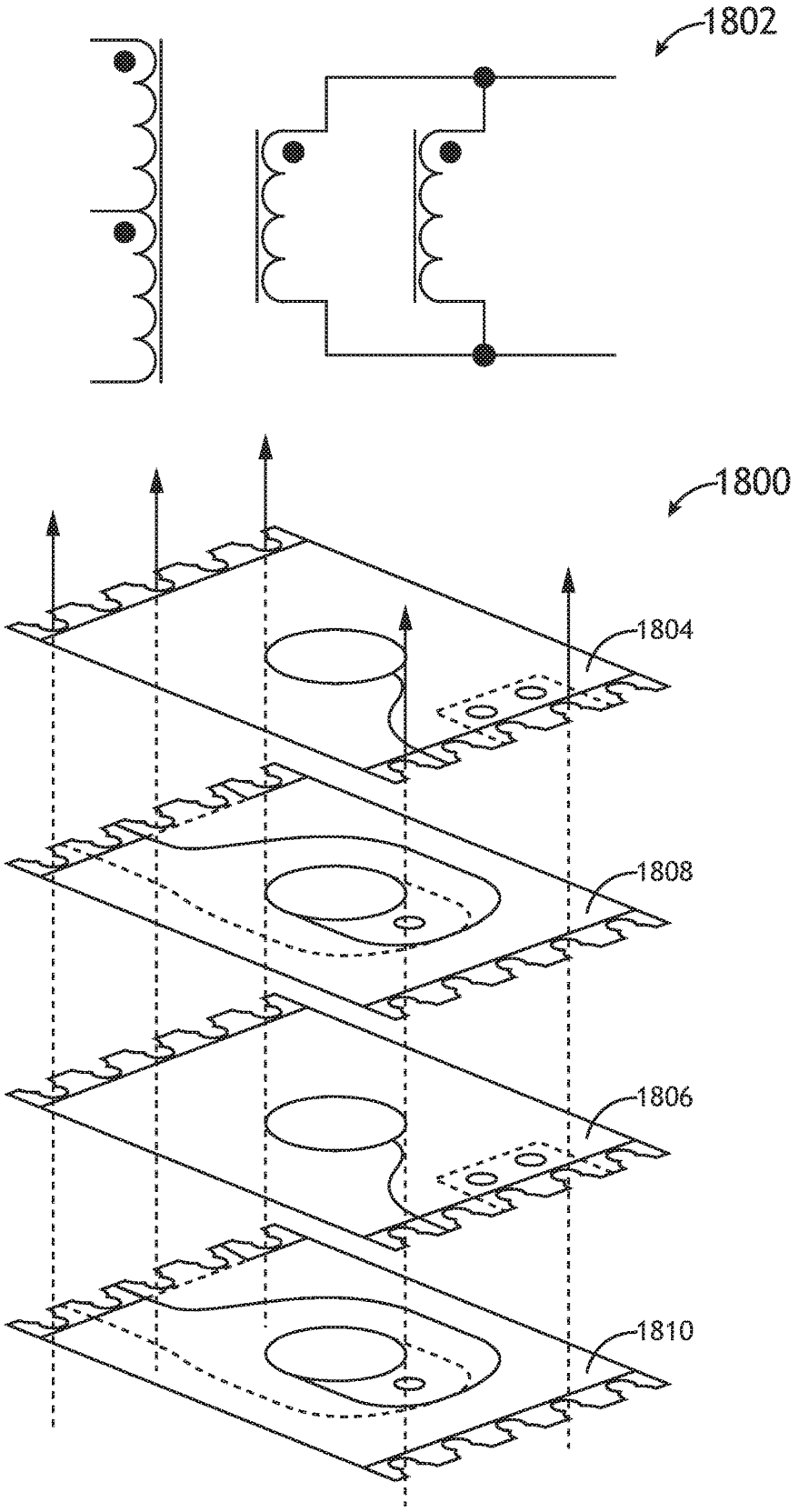
FIG. 18 shows a perspective view of a wafer stack according to an exemplary embodiment.

Referring to FIG. 18, a perspective view of a wafer stack according to an exemplary embodiment is shown. A wafer stack 1800 utilizing embodiments of the present disclosure may be used to implement a series center-tap to parallel transformer diagram 1802. The parallel portion of the stack 1800 includes a first wafer 1804 and a second wafer 1806 connected in parallel as in FIG. 17; likewise, the series center-tap portion of the stack includes a third wafer 1808 and a fourth wafer 1810 as in FIG. 16. The parallel portion wafers 1804, 1806 are rotated about the center hole (and core) such that the corresponding pins are separate from the pins electrically connected to the series center-tap portion wafers 1808, 1810.

It will be appreciated that while four wafers 1804, 1806, 1808, 1810 are shown, any number of wafers 1804, 1806, 1808, 1810 may be utilized according to the application. Likewise, any combination of wafers 1804, 1806, 1808, 1810 may be utilized with respect to the number of windings in each respective wafer 1804, 1806, 1808, 1810 (for example, as set forth in FIGS. 10A, 10B, 11A, 11B, 12A, 12B, 13A, and 13B). Furthermore, any configurations of wafers 1804, 1806, 1808, 1810 may be utilized (for example, as set forth in FIG. 15, 16, or 17).

Parameters such as inter-winding capacitance and leakage inductance are configurable based on winding stack-up. The designing engineers may finely tune the stack-up for optimal performance in a given application.

The number of wafer permutations needed to support a wide range of transformer turns ratios may be reduced base on winding configurability. A relatively small wafer kit enables a wide range of stack configurations. Embodiments of the present disclosure with asymmetric edge connection geometry enables reduced engineering design time and recurring cost.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A printed circuit board wafer comprising:

a first conductive layer disposed on a first surface;

a second conductive layer disposed on a second surface;

a non-conductive core; and one or more vias connecting the first conductive layer to the second conductive layer through the non-conductive core, wherein:

the wafer defines a center hole configured to receive a transformer core element;

the wafer defines a plurality of edge connection points, the plurality of edge connection points comprises a plurality of active edge connection points and a plurality of inactive edge connection points;

at least a first edge connection point is in electronic communication with the first conductive layer but not the second conductive layer;

at least a second edge connection point is in electronic communication with the second conductive layer but not the first conductive layer; and the first conductive layer and second conductive layer are asymmetrical at the plurality of edge connection points.

2. The printed circuit wafer of claim 1, wherein:

the first conductive layer defines a boundary element configured to split the first conductive layer and direct a current from a connected edge connection point, around the center hole, to at least one of the one or more vias.

3. The printed circuit wafer of claim 2, wherein:

the second conductive layer defines a boundary element configured to split the second conductive layer and direct a current from the at least one of the one or more vias, around the center hole, to a connected edge connection point.

4. The printed circuit wafer of claim 1, wherein:

the first conductive layer defines a boundary element configured to split the first conductive layer and direct a current from a connected edge connection point, around the center hole, to at least one of the one or more vias;

the second conductive layer defines a boundary element configured to split the second conductive layer and direct a current from the at least one of the one or more vias, around the center hole, to a connected edge connection point; and the at least one of the one or more vias are disposed proximal to the plurality of edge connection points.

5. The printed circuit wafer of claim 1, wherein:

the first conductive layer defines a boundary element configured to split the first conductive layer and direct a current from a connected edge connection point, around the center hole one and a half times, to at least one of the one or more vias;

the second conductive layer defines a boundary element configured to split the second conductive layer and direct a current from the at least one of the one or more vias, around the center hole one and a half times, to a connected edge connection point; and the at least one of the one or more vias are disposed distal to the plurality of edge connection points.

6. The printed circuit wafer of claim 1, wherein:

the first conductive layer defines a boundary element configured to split the first conductive layer and direct a current from a connected edge connection point, around the center hole two times, to at least one of the one or more vias;

the second conductive layer defines a boundary element configured to split the second conductive layer and direct a current from the at least one of the one or more vias, around the center hole two times, to a connected edge connection point; and the at least one of the one or more vias are disposed proximal to the plurality of edge connection points.

7. The printed circuit wafer of claim 1, wherein:

at least one of the plurality of edge connection points is disposed on a protrusion; and the protrusion is disposed asymmetrically on the wafer.

8. A kit comprising:

A plurality of printed circuit board wafers, each comprising:

a first conductive layer disposed on a first surface;

a second conductive layer disposed on a second surface;

a non-conductive core; and one or more vias connecting the first conductive layer to the second conductive layer through the non-conductive core, wherein:

each wafer:

defines a center hole configured to receive a transformer core element;

defines a plurality of edge connection points comprising a plurality of active edge connection points and a plurality of inactive edge connection points, where at least a first edge connection point is in electronic communication with the first conductive layer but not the second conductive layer; and at least a second edge connection point is in electronic communication with the second conductive layer but not the first conductive layer; and comprises asymmetrical edge connection points respective to the first conductive layer and the second conductive layer;

at least one of the wafers comprises a first conductive layer defining a boundary element configured to split the corresponding first conductive layer and direct a current from a connected edge connection point, around the center hole, to at least one of the one or more corresponding vias;

at least one of the wafers comprises a first conductive layer defining a boundary element configured to split the corresponding first conductive layer and direct a current from a connected edge connection point, around the center hole, to at least one of the one or more corresponding vias and a second conductive layer defining a boundary element configured to split the corresponding second conductive layer and direct a current from the at least one of the one or more vias, around the center hole, to a connected edge connection point.

9. The kit of claim 8, wherein:

the plurality of wafers are configured to be assembled into a series center tap to parallel transformer.

10. The kit of claim 8, wherein at least one of the wafers comprises:

a first conductive layer defining a boundary element configured to split the corresponding first conductive layer and direct a current from a connected edge connection point, around the center hole, to at least one of the one or more corresponding vias;

a second conductive layer defines a boundary element configured to split the corresponding second conductive layer and direct a current from the at least one of the one or more corresponding vias, around the center hole, to a connected edge connection point; and wherein the at least one of the one or more corresponding vias are disposed proximal to the corresponding plurality of edge connection points.

11. The kit of claim 8, wherein at least one of the wafers comprises:

a first conductive layer defining a boundary element configured to split the corresponding first conductive layer and direct a current from a connected edge connection point, around the center hole one and a half times, to at least one of the one or more corresponding vias;

a second conductive layer defining a boundary element configured to split the corresponding second conductive layer and direct a current from the at least one of the one or more corresponding vias, around the center hole one and a half times, to a connected edge connection point; and wherein the at least one of the one or more corresponding vias are disposed distal to the corresponding plurality of edge connection points.

12. The kit of claim 8, wherein at least one of the wafers comprises:

a first conductive layer defining a boundary element configured to split the corresponding first conductive layer and direct a current from a connected edge connection point, around the center hole two times, to at least one of the one or more corresponding vias;

a second conductive layer defining a boundary element configured to split the corresponding second conductive layer and direct a current from the at least one of the one or more corresponding vias, around the center hole two times, to a connected edge connection point; and wherein the at least one of the one or more corresponding vias are disposed proximal to the corresponding plurality of edge connection points.

13. The kit of claim 8, wherein:

the wafers in the plurality of wafers may be interleaved in any order by stacking around a transformer core element.

* * * * *